US010470636B2

(12) United States Patent
Farmer et al.

(10) Patent No.: US 10,470,636 B2
(45) Date of Patent: Nov. 12, 2019

(54) MOBILE CLEANING ROBOT CLEANING HEAD

(71) Applicant: iRobot Corporation, Bedford, MA (US)

(72) Inventors: William Farmer, Bedford, MA (US); Thomas P. Schregardus, Somersville, MA (US); Eric Burbank, Bedford, MA (US)

(73) Assignee: iRobot Corporation, Bedford, MA (US)

( * ) Notice: Subject to any disclaimer, the term of this patent is extended or adjusted under 35 U.S.C. 154(b) by 157 days.

(21) Appl. No.: 15/829,357

(22) Filed: Dec. 1, 2017

(65) Prior Publication Data

US 2018/0199785 A1 Jul. 19, 2018

Related U.S. Application Data

(60) Provisional application No. 62/447,112, filed on Jan. 17, 2017.

(51) Int. Cl.

| | |
|---|---|
| ***A47L 11/40*** | (2006.01) |
| ***A47L 9/04*** | (2006.01) |
| ***A47L 9/28*** | (2006.01) |
| ***A47L 9/00*** | (2006.01) |
| ***A47L 9/06*** | (2006.01) |

(Continued)

(52) U.S. Cl.

CPC ..... *A47L 11/4041* (2013.01); *A47L 9/009* (2013.01); *A47L 9/0411* (2013.01); *A47L 9/0472* (2013.01); *A47L 9/0477* (2013.01); *A47L 9/068* (2013.01); *A47L 9/12* (2013.01); *A47L 9/22* (2013.01); *A47L 9/281* (2013.01);

(Continued)

(58) Field of Classification Search

CPC ... A47L 11/40; A47L 11/4041; A47L 11/4025

See application file for complete search history.

(56) References Cited

U.S. PATENT DOCUMENTS 6,883,201 B2 * 4/2005 Jones ..... A47L 5/30 15/319

6,956,348 B2 9/2005 Landry et al.

(Continued)

OTHER PUBLICATIONS

"SR8845. Robotic Vacuum Cleaner User Manual," Samsung, available at www.samsung.com, [undated], 48 pages.

(Continued)

*Primary Examiner* — Michael D Jennings

(74) *Attorney, Agent, or Firm* — Fish & Richardson P.C.

(57) ABSTRACT

This document describes a mobile cleaning robot that includes a chassis that supports a drive system, a debris collection volume; and a cleaning head formed to complete a bottom of the robot. The cleaning head includes a frame for affixing the cleaning head to the chassis, a monolithic housing having an interior cavity, a suspension linkage movably suspending the monolithic housing from the frame, the suspension linkage being configured to lift the monolithic housing, a diaphragm formed of a flexible material and mated to the monolithic housing, a rigid duct mated the frame to form a pneumatic path between the monolithic housing and the rigid duct through the diaphragm, and cleaning extractors disposed in the interior cavity of the monolithic housing.

20 Claims, 22 Drawing Sheets

(51) Int. Cl.
*A47L 9/12* (2006.01)
*A47L 9/22* (2006.01)

(52) U.S. Cl.
CPC ..... *A47L 11/4025* (2013.01); *A47L 11/4077* (2013.01); *A47L 2201/04* (2013.01); *A47L 2201/06* (2013.01)

(56) References Cited

U.S. PATENT DOCUMENTS

| | | | |
|---|---|---|---|
| 7,288,912 | B2 | 10/2007 | Landry et al. |
| 7,441,298 | B2 | 10/2008 | Svendsen et al. |
| 7,459,871 | B2 | 12/2008 | Landry et al. |
| D586,959 | S | 2/2009 | Geringer et al. |
| 8,087,117 | B2 | 1/2012 | Kapoor et al. |
| 8,253,368 | B2 | 8/2012 | Landry et al. |
| 8,378,613 | B2 | 2/2013 | Landry et al. |
| 8,386,081 | B2 | 2/2013 | Landry et al. |
| 8,418,303 | B2 | 4/2013 | Kapoor et al. |
| 8,428,778 | B2 | 4/2013 | Landry et al. |
| 8,456,125 | B2 | 6/2013 | Landry et al. |
| 8,598,829 | B2 | 12/2013 | Landry et al. |
| 8,600,553 | B2 | 12/2013 | Svendsen et al. |
| 8,661,605 | B2 | 3/2014 | Svendsen et al. |
| 8,781,626 | B2 | 7/2014 | Landry et al. |
| 8,978,196 | B2 | 3/2015 | Svendsen et al. |
| 9,144,361 | B2 | 9/2015 | Landry et al. |
| 9,320,398 | B2 | 4/2016 | Hussey et al. |
| 9,326,654 | B2 | 5/2016 | Doughty et al. |
| 9,591,959 | B2 | 3/2017 | Landry et al. |
| 9,883,783 | B2 | 2/2018 | Landry et al. |
| 9,949,608 | B2 | 4/2018 | Landry et al. |
| 2005/0218852 | A1 | 10/2005 | Landry et al. |
| 2007/0204426 | A1 | 9/2007 | Nakagawa et al. |
| 2011/0088203 | A1 | 4/2011 | Song et al. |
| 2012/0090126 | A1 | 4/2012 | Kim et al. |
| 2012/0102670 | A1 | 5/2012 | Jang et al. |
| 2013/0061417 | A1 | 3/2013 | Vanderstegen-Drake et al. |
| 2013/0205520 | A1 | 8/2013 | Kapoor et al. |
| 2014/0053351 | A1 | 2/2014 | Kapoor et al. |
| 2016/0058256 | A1 | 3/2016 | Ju et al. |
| 2016/0166127 | A1 | 6/2016 | Lewis et al. |
| 2016/0213217 | A1 | 7/2016 | Doughty et al. |
| 2018/0199780 | A1 | 7/2018 | Landry et al. |
| 2018/0263454 | A1 | 9/2018 | Landry et al. |

OTHER PUBLICATIONS

Black and Decker Robotic Vacuum Instruction Manual. Catalog No. BDH500, 2016, 17 pages.

Dyson 360 Eye Robot User Manual, "How to use your robot," 32 pages, Apr. 12, 2016.

Hoover Quest 1000 Manual, available at http://hoover.com/., 57 pages, 2016.

Hoover Quest 800 Manual, available at http://hoover.com/., 56 pages, 2016.

International Search Report and Written Opinion in International Application No. PCT/US18/14089, dated Apr. 30, 2018, 6 pages.

Neato Botvac User Manual, "Neato Botvac. Let it run. Your work is done.," Neato Robotics, Inc., available at neatrobotics.com, [undated], 27 pages.

Neato Product Set Up Guide, "Start Here," Neato Robotics, Inc., [undated], 2 pages.

Neato User Guide, "botvac D3 connected, botvac D5 connected," Neato Robotics, Inc., available at neatorobotics.com, [undated], 164 pages.

U.S. Appl. No. 62/614,328, filed Jan. 5, 2018, 93 pages.

* cited by examiner

MOBILE CLEANING ROBOT CLEANING HEAD

CROSS-REFERENCE TO RELATED APPLICATIONS

This application is a claims priority to U.S. Application Ser. No. 62/447,112, filed on Jan. 17, 2017.

TECHNICAL FIELD

This specification relates to a cleaning head for a mobile cleaning robot.

BACKGROUND

A mobile cleaning robot can navigate over a surface such as a floor and clean debris from the surface. A cleaning head affixed to the mobile cleaning robot engages the surface and retrieves the debris. The collected debris is stored in a bin.

SUMMARY

This document describes a mobile cleaning robot that includes a chassis that supports a drive system, a debris collection volume; and a cleaning head formed to complete a bottom of the robot. The cleaning head includes a frame for affixing the cleaning head to the chassis, a monolithic housing having an interior cavity, a suspension linkage movably suspending the monolithic housing from the frame, the suspension linkage being configured to lift the monolithic housing, a diaphragm formed of a flexible material and mated to the monolithic housing, a rigid duct mated to the frame to form a pneumatic path between the monolithic housing and the rigid duct through the diaphragm, and cleaning extractors disposed in the interior cavity of the monolithic housing.

In some implementations, the mobile cleaning robot further includes a square forward portion comprising a lateral axis from a first side to a second side, the cleaning head being integrated into the square forward portion across the lateral axis of the square forward portion, the cleaning extractors extending across the lateral axis within 1 centimeter of one of the first or second sides.

In some implementations, the mobile cleaning robot further includes a corner brush disposed in a position of the square forward portion between a leading edge of the forward portion and the cleaning extractors, and a motor for driving the corner brush, the motor being positioned inside the frame in a vertical configuration with the corner brush (e.g., perpendicular to a vertical axis of the corner brush). The drive system is further from the leading edge than the cleaning extractors.

In some implementations, the diaphragm further includes a first seal formed with the rigid duct by compressing an extension of the diaphragm. In some implementations, the diaphragm includes a second seal formed with the monolithic housing and comprising a double flange configuration having a top flange and a bottom flange separated by a receiving channel. The receiving channel receives a lip of the monolithic housing. The bottom flange is received through an aperture of the monolithic housing into the interior cavity of the monolithic housing, and the top flange being mated to a top surface of the monolithic housing. In some implementations, the mating of the diaphragm to the monolithic housing forms the pneumatic path from the interior cavity of the monolithic housing to an intake port of the debris collection volume. In some implementations, the first seal of the mobile cleaning robot is formed by a knife-edge seal of the rigid duct pressing into the diaphragm extension.

In some implementations, mating the diaphragm to the monolithic housing includes forming a chemical bond between the diaphragm and the monolithic housing.

In some implementations, the suspension linkage includes a four-bar assembly coupling the moveable monolithic housing to the chassis. The suspension linkage is attached adjacent the pneumatic path and inwardly spaced from lateral ends of the monolithic housing.

In some implementations, the monolithic housing is constructed from a single molded piece of rigid material shaped to conform the interior cavity to a shape of the cleaning extractors disposed in the interior cavity. The frame is shaped to form a beveled bottom edge.

In some implementations, the monolithic housing further includes output gears configured to receive the cleaning extractors. In some implementations, the output gears each include a seal. In some implementations, the cleaning extractors are pliable tubular rollers. In some implementations, the monolithic housing includes a latch configured to secure the pliable tubular rollers inside the interior cavity.

In some implementations, the mobile cleaning robot includes a gearbox in communication with the output gears configured to drive the output gears and rotate the cleaning extractors. In some implementations, the gearbox is adjacent to an end of the monolithic housing and extends less than three centimeters from the end of the monolithic housing. In some implementations, the cleaning head includes a motor for driving the gearbox, and the motor is affixed to a top of the monolithic housing.

In some implementations, the cleaning head includes a tuned spring that balances the monolithic housing to maintain the monolithic housing approximately parallel to the cleaning surface during operation.

In some implementations, the suspension linkage includes housing carriers that are formed from the monolithic housing, frame carriers that are formed from the frame, suspension links that connect the frame carriers to the housing carriers, and joints that receive the suspension links on pins of the joints and allow the suspension links to pivot around the pins. In some implementations, the housing carriers and frame carriers are configured to receive the joints.

In some implementations, the suspension linkage and the diaphragm are configured to allow the monolithic housing to float along the cleaning surface independent of the movement of the frame.

In some implementations, the rigid duct comprises a debris detection sensor.

In some implementations, the mobile cleaning robot includes an aft cover, wherein the aft cover mates with the frame to complete the bottom of the robot. In some implementations, the mobile cleaning robot includes a bin well for receiving the debris collection volume. In some implementations, the bin well is covered by a lid during cleaning operation. In some implementations, the cleaning operation are restricted when the lid is ajar.

In some implementations, the diaphragm folds when the monolithic housing is in a raised state. The folds do not reduce a cross-section of the pneumatic airflow path through the diaphragm. In some implementations, the suspension linkage comprises a flex-bearing hinge. In some implementations, the rigid duct forms a seal with an intake port of the debris collection volume. In some implementations, a latch is configured to secure the cleaning extractors in the monolithic housing. In some implementations, the latch includes a lap joint to seal with the monolithic housing. In some implementations, the lap joint is oriented to reduce debris buildup in the lap joint relative to another orientation of the lap joint.

The mobile cleaning robot includes several advantages. The cleaning head of the mobile cleaning robot is suspended on the cleaning surface to ride contours, undulations, and other features of the cleaning surface. Specifically, a portion of the cleaning head "floats" on the cleaning surface such that the cleaning extractors and the edges of the monolithic housing of the cleaning head rides the contours, undulations, and other features of the cleaning surface even if the features are too small for the body of the mobile cleaning robot to follow. The contact of the monolithic housing of the cleaning head with the cleaning surface reduces air leakages that degrade suction of the cleaning head.

The positioning of the suspension linkage in the center of the mobile cleaning robot and above the cleaning extractors enables the suspension linkage to raise and lower the monolithic housing of the cleaning head to "float" on the cleaning surface. The suspension linkage raises and lowers the cleaning head level (e.g., parallel) to the cleaning surface along the lateral axis of the mobile cleaning robot. The suspension linkage can raise and lower the monolithic housing without tilting the monolithic housing forward or backward such that bottom edges of the monolithic housing contact and follow the contours, undulations, and other features of the cleaning surface, reducing air leakages out the bottom edges of the monolithic housing that degrade suction.

The diaphragm seals the pneumatic pathway of the mobile cleaning robot and allows the monolithic housing of the cleaning head to move freely using the suspension linkage. The diaphragm does not hinder the motion of the cleaning head while the cleaning head is floating on the cleaning surface. The diaphragm does not obstruct the pneumatic pathway of the mobile cleaning robot as the cleaning head moves due to the suspension linkage. The diaphragm is shaped to flex such that the diaphragm allows the cleaning head to move without stretching or compressing the diaphragm material.

The monolithic housing enables stronger, more uniform suction on the cleaning surface underneath the cleaning head. The corner brush is disposed very close to the edge of the mobile cleaning robot such that the corner brush can reach debris in corners of a cleaning surface. The cleaning extractors extend across nearly the entire lateral axis of the mobile cleaning robot and are positioned at the widest lateral portion of the mobile cleaning robot.

The details of one or more implementations of the subject matter described in this specification are set forth in the accompanying drawings and the description below. Other potential features, aspects, and advantages will become apparent from the description, the drawings, and the claims.

BRIEF DESCRIPTION OF THE DRAWINGS

Like reference numbers and designations in the various drawings indicate like elements.

DETAILED DESCRIPTION

A mobile cleaning robot can navigate around a room or other locations and clean a surface over which it moves. In some implementations, the robot navigates autonomously. The mobile cleaning robot collects dust and debris from the surface and stores the dust and debris in a bin. The mobile cleaning robot includes a cleaning head that engages the surface to extract debris from the surface. Cleaning extractors agitate debris on the surface to assist the mobile cleaning robot in cleaning (e.g., vacuuming) the debris from the surface. The cleaning head is affixed to the mobile cleaning robot by a mechanical suspension linkage that allows the cleaning head to adjust to height variations in the surface. The cleaning head rides over the cleaning surface such that the cleaning extractors maintain contact with the cleaning surface during movement of the mobile cleaning robot. The cleaning head includes a monolithic housing that is mated to a diaphragm. The monolithic housing is formed from a single, molded piece of rigid or semi-rigid material, rather than by being formed from two or more pieces of material that are mated together. The monolithic structure of the monolithic housing reduces seams and air gaps that are caused by forming a housing from two or more pieces of material. The monolithic housing holds the cleaning extractors. The monolithic housing defines an initial portion of a pneumatic airflow path for carrying debris to a bin of the mobile cleaning robot. The cleaning head "floats" on the cleaning surface by riding the cleaning surface to follow the elevation profile of the cleaning surface. The suspension linkage enables the monolithic housing to maintain contact with the cleaning surface during movement of the cleaning robot over undulations in the cleaning surface, thereby reducing air leakage caused by gaps between the monolithic housing and the cleaning surface. The reduced air leakage enables increased suction of the mobile cleaning robot for removing debris from the cleaning surface.

Figure 1:
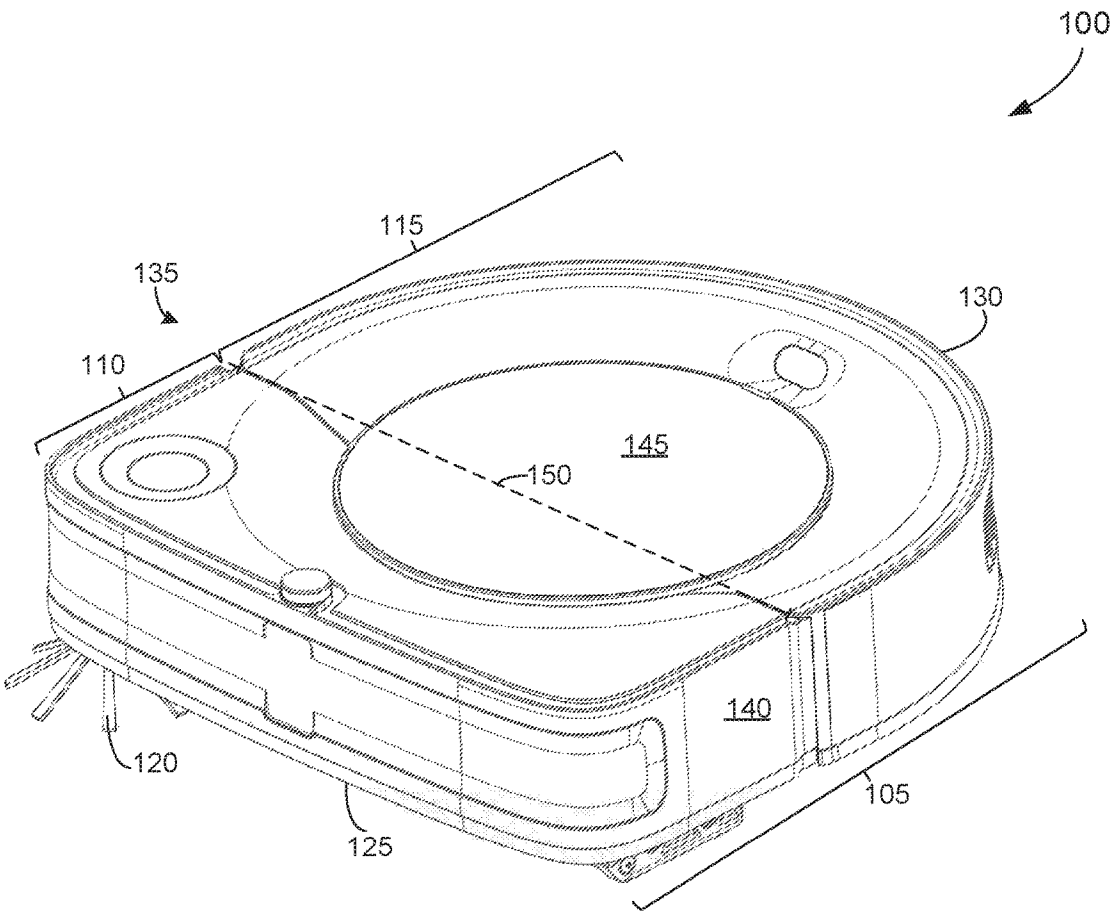
FIG. 1 is a perspective top view of an example mobile cleaning robot.

FIG. 1 shows a mobile cleaning robot 100 that can autonomously navigate a cleaning surface and perform cleaning operation (e.g., vacuum operations) on the cleaning surface. The mobile cleaning robot 100 includes a body having a forward portion 110 and an aft portion 115. In some implementations, the forward portion 110 of the body includes a squared-off or substantially flat leading edge 125, for example, when viewed from above. In this example, the aft portion 115 includes a rounded (e.g., semi-circular) trailing edge 130 when viewed from above to form a "D" shape or "tombstone" shape; however, other individual shapes, multiple shapes, etc. may be employed in the aft portion 115 design or the forward portion 110 design.

The leading edge 125 of the mobile cleaning robot 100 extends along a lateral axis of the mobile cleaning robot 100, denoted in FIG. 1 by axis 150. The axis 150 extends from a first side 135 of the mobile cleaning robot 100 to a second side 140 of the forward portion 110 of the mobile cleaning robot 100. During cleaning operation, the leading edge 125 of the mobile cleaning robot 100 is typically, but not always, the first portion of the mobile cleaning robot 100 to cross a portion of the cleaning surface. For example, if the mobile cleaning robot 100 is performing cleaning operation in a straight line, moving forward, the leading edge 125 crosses the cleaning surface before other portions of the body of the mobile cleaning robot 100.

Figure 4:
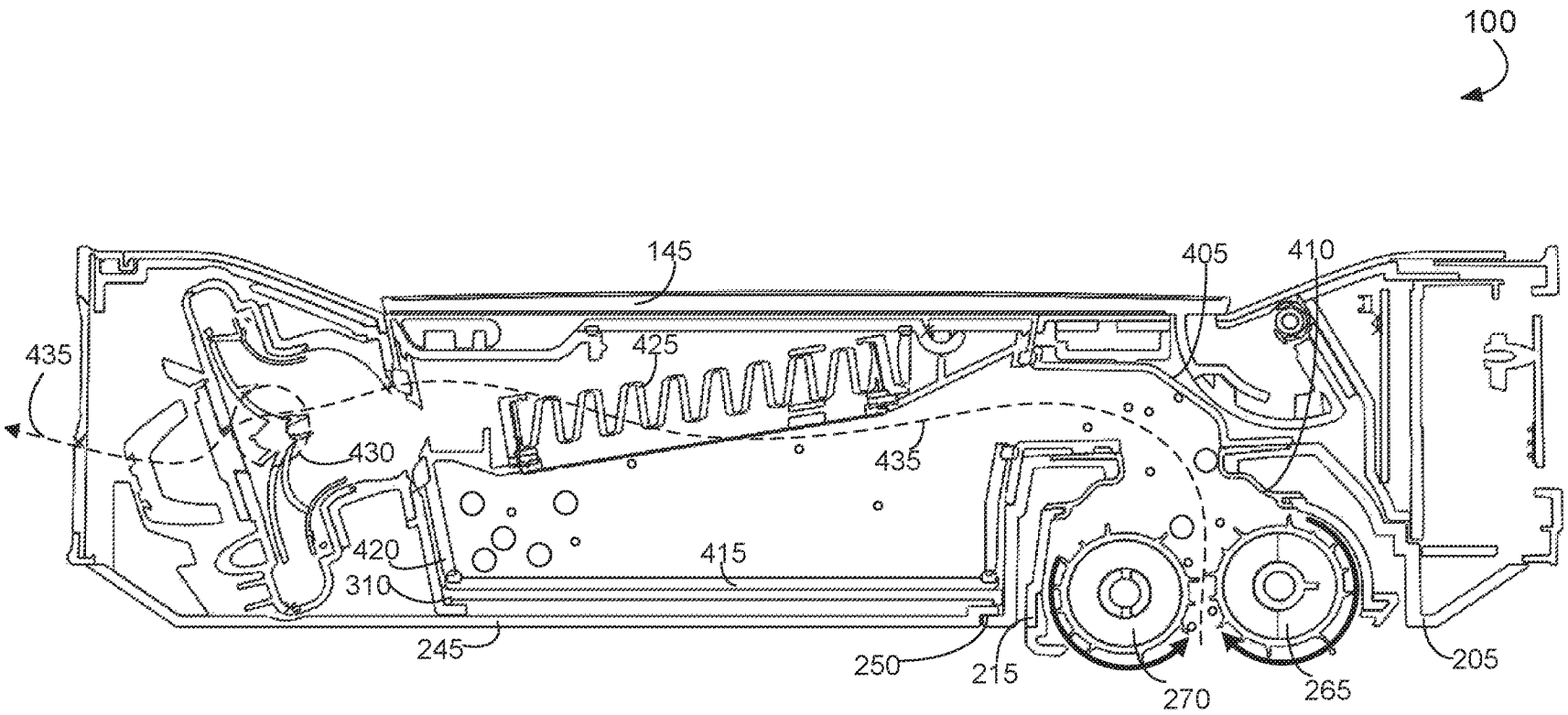
FIG. 4 is a schematic cutaway side view of the mobile cleaning robot of FIGS. 1-3.

The mobile cleaning robot 100 (hereinafter, "robot 100") includes a lid 145. As shown in FIG. 4, the lid 145 covers a bin well 420 in a chassis 310 for a bin 415. Turning back to FIG. 1, the lid 145 can prevent the bin 415 from shifting during operations of the robot 100 and prevent the bin 415 from being removed during operation of the robot 100 (e.g., during cleaning operation). The lid 145 is affixed to the robot 100 by a hinge such that the lid 145 swings open and closed over the bin 415. In some implementations, the lid 145 closes over the bin 415 when the bin 415 is properly seated in the robot 100. However, if the bin 415 is improperly seated, the bin 415 prevents the lid 145 from swinging closed to cover the bin 415 because at least a portion of the bin 415 extends into the swinging path of the lid 145. In some implementations, a visual indication from the lid 145 may alert a user that the bin 415 is not fully or completely aligned with the bin well 420, thereby providing a visual prompt that a corrective action is needed (e.g., an adjustment of the bin 415). In some implementations, the robot 100 includes one or more mechanisms to prevent the robot 100 from operating when the lid 145 is ajar. The mechanism can include one or more of a switch, electrical contact, sensor, and so forth for detecting that the lid 145 is ajar.

Figure 2:
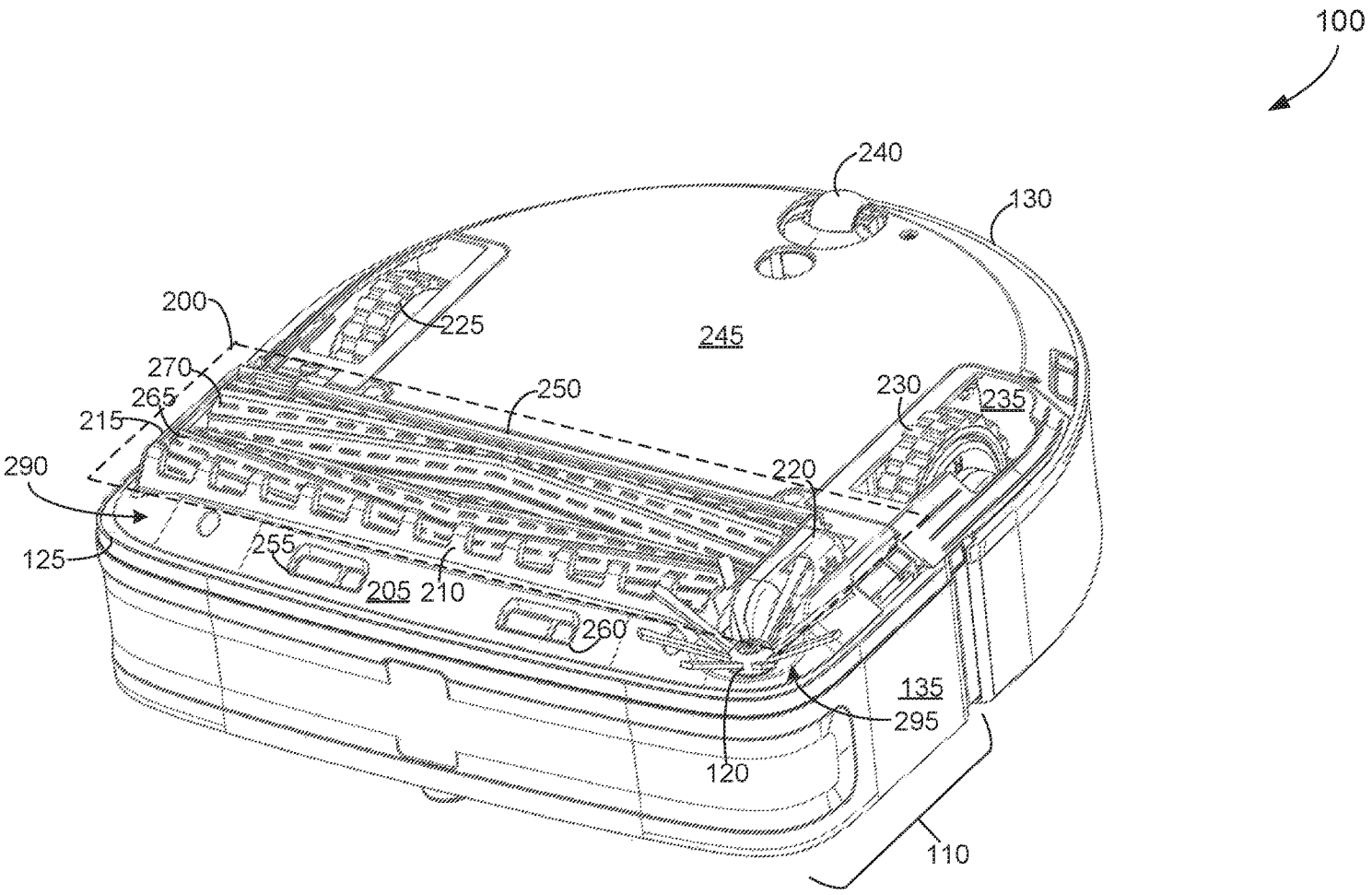
FIG. 2 is a perspective view showing a bottom of the mobile cleaning robot of FIG. 1.

FIG. 2 is a perspective view showing the bottom of the robot 100 including a cleaning head 200. The cleaning head 200 is positioned at the forward portion 110 of the robot 100 proximate the leading edge 125. The leading edge 125 includes a substantially squared-off portion such that the cleaning head (approximated by a dashed line 200) extends substantially across the axis 150 of the robot. The cleaning head 200 includes a frame 205 that forms a portion of the leading edge 125 of the robot 100. The frame 205 includes apertures for sensors 255, 260 near the leading edge 125 of the robot 100. Cleaning extractors 265, 270 are positioned inside a monolithic housing 215 of the cleaning head. A corner brush 120 is positioned near a corner of the cleaning head 200 in the frame 205.

The cleaning head 200 is positioned near or at the leading edge 125 of the robot 100 to engage the cleaning surface ahead of other portions of the robot 100. The cleaning head 200 is positioned closer to the forward portion 110 of the robot 100 than the wheels 225, 230 and can extend across the robot 100 in front of the wheels 225, 230. One advantage of such an arrangement is that the cleaning head 200 can extend across nearly the entire lateral span of the robot 100, compared to a more restricted spacing if the cleaning head is positioned between the wheels 225, 230. The length of the cleaning head 200 enables one or more cleaning extractors 265, 270 of the cleaning head 200 to extend substantially across the lateral width 150 defined between the first side 135 and the second side 140 of the robot 100. The cleaning surface can be cleaned more quickly because fewer passes by the robot 100 are needed to cover the cleaning surface than if the cleaning head did not extend substantially across the lateral width 150 of the robot. Additionally, the robot 100 can cover a greater surface area of the cleaning surface before requiring recharge, reducing a number of trips to a recharge station and increasing the efficiency of the robot 100.

In some implementations, the cleaning head 200 extends across the entire axis 150 of the robot 100. In some implementations, the cleaning extractors 265, 270 extend over 90% of the axis 150 of the robot 100. In some implementations, the cleaning extractors 265, 270 extend across the axis 150 of the robot 100 to within 1 centimeter of one of the first or second sides 135, 140 of the robot 100. In some implementations, the cleaning extractors 265, 270 extend across the axis 150 of the robot 100 to between 1-5 centimeters of the first and second sides 135, 140 of the robot 100.

The cleaning extractors 265, 270 can clean more of the cleaning surface over which the robot 100 moves because the cleaning extractors 265, 270 extend substantially across the axis 150 of the robot 100. For example, the cleaning extractors 265, 270 can clean edges of the cleaning surface, such as portions of the cleaning surface near obstacles, such as walls, corners, and so forth. The portions of the cleaning surface near obstacles could be unreachable by the cleaning extractors 265, 270 if they did not extend substantially the lateral width 150 of the robot 100, and the robot 100 might need to maneuver the corner brush 120 to clean these portions of the cleaning surface. The length of the cleaning extractors 265, 270 reduce a need to clean the cleaning surface using the corner brush 120 relative to cleaning extractors that do not extend close to the first side 135 and second side 140 of the robot 100.

Figure 7:
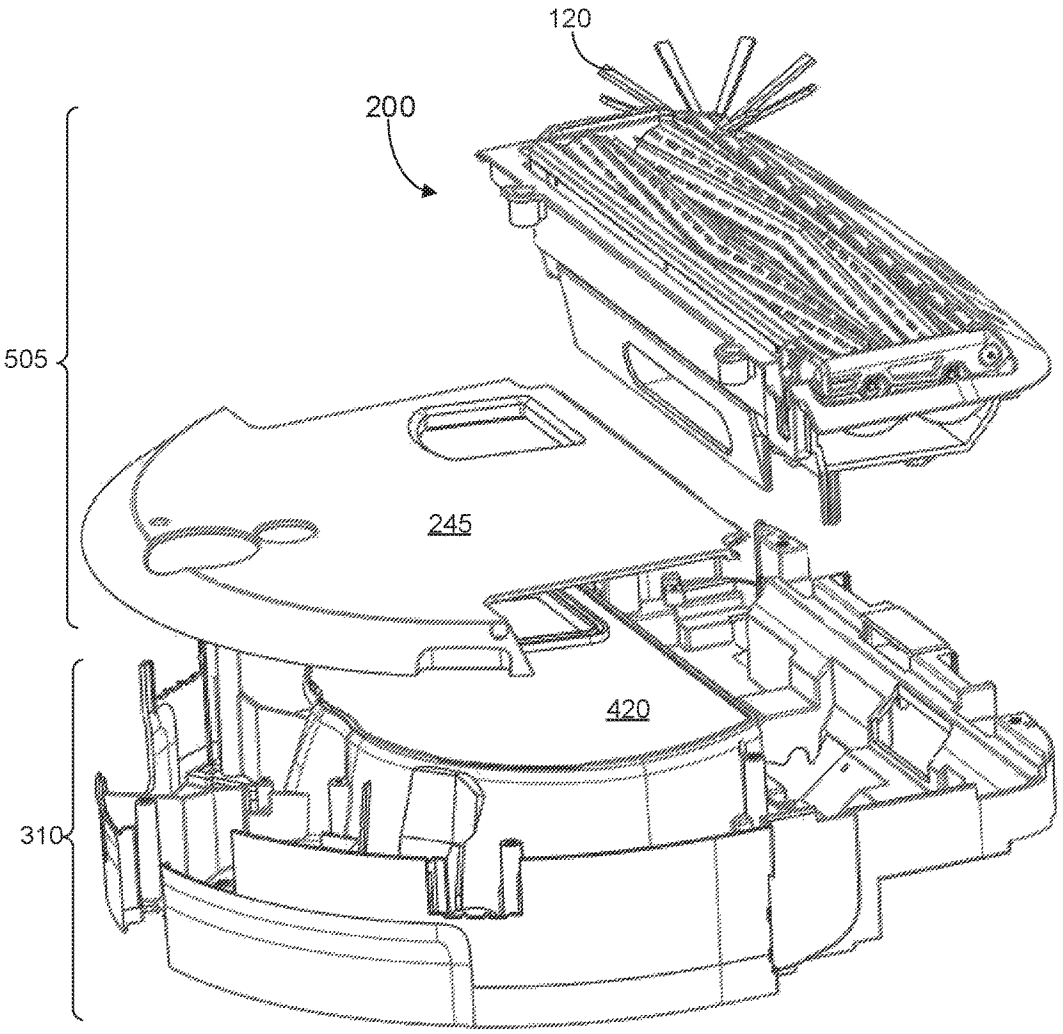
FIG. 7 is an exploded perspective bottom view of the mobile cleaning robot of FIGS. 1-6.

The cleaning head 200 is affixed to the robot 100 such that the monolithic housing 215 moves independently from the frame 205 and other portions of the robot 100. As seen in FIG. 7, the cleaning head 200 is mounted to a chassis 310 of the robot 100. Turning back to FIG. 2, the monolithic housing 215 is suspended from frame 205 such that the cleaning extractors 265, 270 ride over the contours of the cleaning surface. The monolithic housing 215 rides along the cleaning surface such that the cleaning extractors 265, 270 ride along undulations of the cleaning surface without lifting away from the cleaning surface. The monolithic housing 215 of the cleaning head 200 can move closer to and further from the cleaning surface independently of the movement of the wheels 225, 230. For example, the wheels 225, 230 retract and extend from the robot 100 for maneuvering the robot 100 over larger undulations in a cleaning surface, such as a change from a hard smooth surface to a soft (e.g., carpeted) surface. For example, when the robot 100 navigates from a soft, plush surface to a hard smooth surface, the monolithic housing 215 of the cleaning head 200 lowers to the hard, smooth surface. When the robot 100 navigates from a hard surface to a soft surface, the monolithic housing 215 of the cleaning head 200 rides up onto the soft, plush surface.

Figure 3:
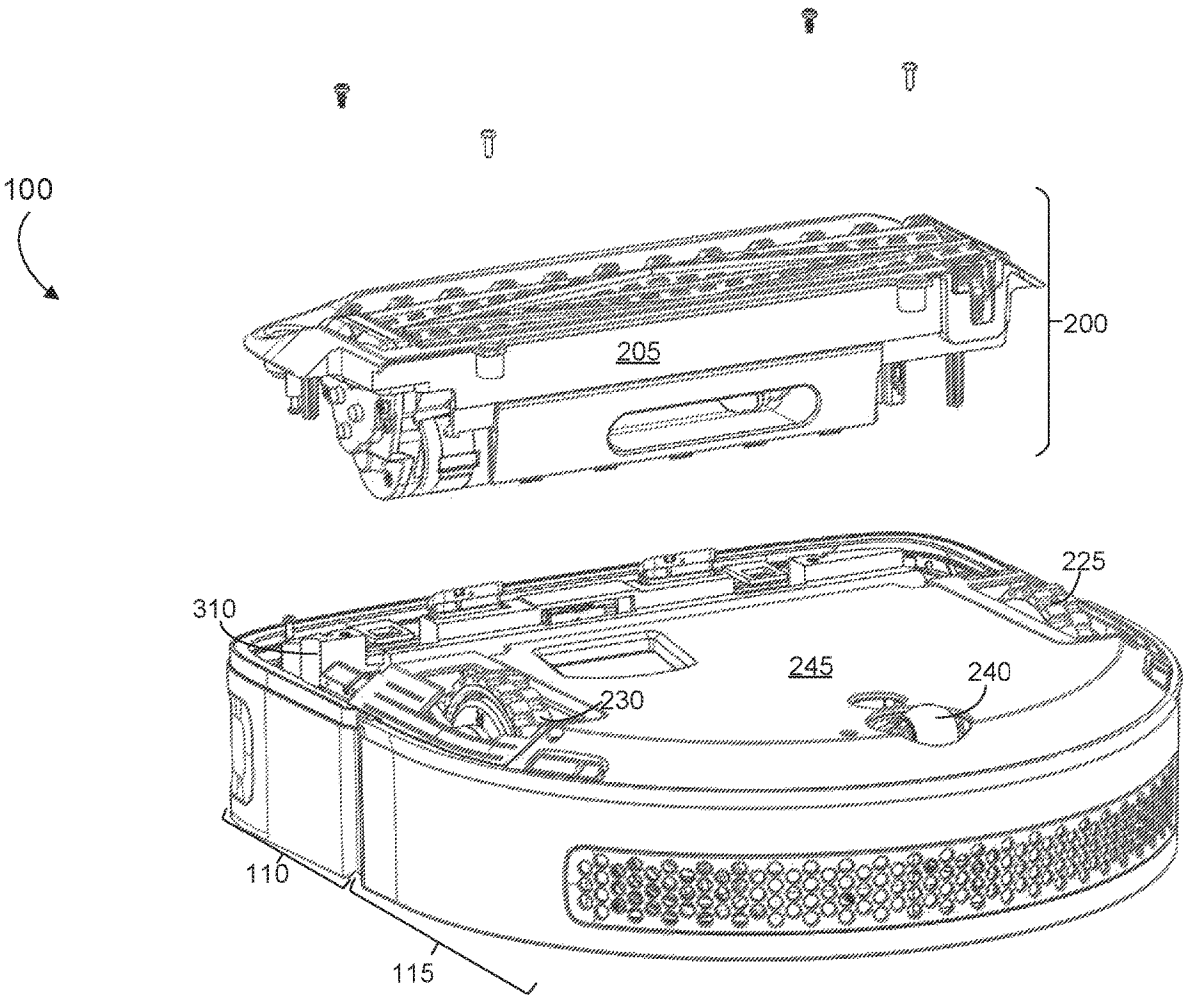
FIG. 3 is an exploded perspective view showing the bottom of the mobile cleaning robot of FIG. 2.

The frame 205 is formed from a rigid or semi-rigid material. The frame 205 includes a sloping front portion 290 to create a beveled bottom edge at or near the leading edge 125 of the robot 100. The sloping front portion 290 allows the robot 100 to navigate across surfaces with uneven terrain and accommodate changes in flooring height (e.g., hard flooring to a carpeted surface). The sloping front portion 290 extends in front of the monolithic housing 215. The frame 205 forms a shape that mounts onto the chassis 310 (as described in relation to FIG. 7, below) and integrates with an aft cover 245 of the robot 100, such as using a lap joint 250. The frame 205 and the aft cover 245 complete the bottom of the robot 100, forming a substantially continuous surface and smooth surface that runs smoothly over the cleaning surface without trapping debris. In some implementations, the frame 205 integrates smoothly with the aft cover 245 of the robot 100 such that there are no edges or corners that can snag on a cleaning surface (e.g., a carpet). In some implementations, the frame 205 integrates smoothly with the bottom portion of the robot 100. As seen in FIG. 3, the frame 205 fastens to the robot 100 by mounting on the chassis 310, such as with screws.

Turning back to FIG. 2, the sloping front portion 290 of the frame 205 includes one or more apertures for sensors, such as front proximity sensors 255, 260. The front proximity sensors 255, 260 assist the robot 100 in navigating around the cleaning surface. For example, the front proximity sensors 255, 260 include a ranging sensor, such as an infrared sensor, or other sensor that detects a vertical separation of the forward end of the robot 100 from the cleaning surface. If the robot 100 approaches an edge, such as a staircase landing, etc., the front proximity sensors 255, 260 send a signal to halt the robot 100, and the robot 100 can back away from the edge. Several front sensors can work together, such as to provide a differential signal or a redundant signal.

The corner brush 120 is positioned proximate the leading edge 125 of the robot 100 and is supported by the frame 205. The corner brush 120 includes bristles extending from a central shaft rotated by a motor. In some implementations, the corner brush 120 or a portion thereof (such as the bristles) extends past an exterior edge of the robot 100, such as the leading edge 125 or the first side 135 of the robot 100. In some implementations, the corner brush 120 is positioned in front of the cleaning extractors 265, 270. In some implementations, the corner brush 120 sweeps debris into a path of the cleaning head 200 during cleaning operation. In some implementations, the corner brush 120 sweeps debris off of vertical surfaces near the robot 100 for removal by the cleaning extractors 265, 270, such as debris located on the obstacles (e.g., baseboards, furniture legs, etc.).

Figure 8:
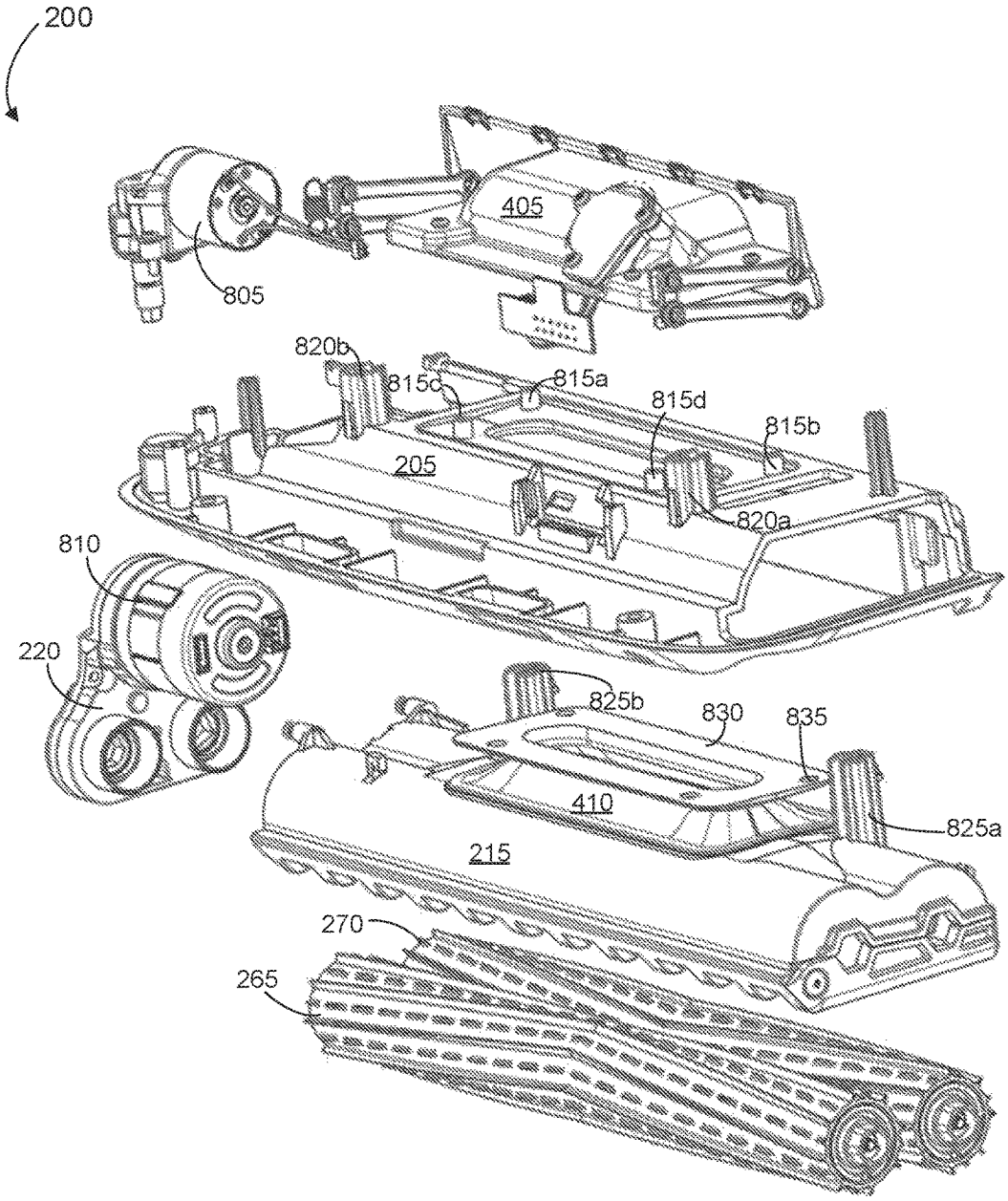
FIG. 8 is an exploded perspective view of the cleaning head of the mobile cleaning robot of FIGS. 1-7.

The corner brush 120 is driven by a corner brush motor 805. As seen in FIG. 8, the corner brush motor 805 is positioned on the frame 205 of the cleaning head 200. The corner brush motor 805 is coupled to a corner brush gearbox (e.g., gearbox 2020 of FIG. 20). The corner brush gearbox is disposed in a vertical configuration with the corner brush 120. The corner brush motor 805 is positioned adjacent to the corner brush gearbox and proximate the sloping front portion 290 of the frame 205. The configuration of the corner brush motor 805 and the corner brush gearbox allows the corner brush 120 to be positioned close to a squared-off corner 295 of the forward portion 110 of the robot 100 near the leading edge 125. In some implementations, the shaft of the corner brush motor 805 extends through the frame 205 less than one centimeter from the squared-off corner 295 of the forward portion 110 of the robot 100. In some implementations, the corner brush 120 is between 70-90 mm across. In some implementations, the corner brush 120 is larger than 90 mm.

Turning back to FIG. 2, the monolithic housing 215 includes an interior cavity (e.g., interior cavity 1505 of FIG. 15) for supporting the cleaning extractors 265, 270. The monolithic housing 215 is coupled to and suspended from the frame 205 such that the monolithic housing 215 can move independently of the frame 205 and "float" on the cleaning surface as the robot 100 moves, as previously described. The monolithic housing forms the initial portion of the pneumatic pathway of the robot 100. The monolithic housing is suspended from the frame 205 such that bottom edges of the monolithic housing contact the cleaning surface, reducing air leakage from the pneumatic pathway that occurs between the cleaning surface and the sides of the monolithic housing 205. A negative pressure can be applied in the airflow path such that debris is vacuumed through the cleaning extractors 265, 270 and into the monolithic housing 215. In some implementations, the monolithic housing 215 includes an edge that terminates in raking prows 210. The raking prows 210 can rake through a soft surface (e.g., a carpet, rug, etc.) during cleaning operation and prepare the surface for cleaning by the cleaning extractors 265, 270 as the robot 100 navigates over the surface. The raking prows 210 ensure that debris that are too large to be removed from the cleaning surface by the cleaning head 200 do not pass beneath the cleaning extractors 265, 270, such as large debris can that can become stuck or wedged in the cleaning extractors 265, 270. In some implementations, the gaps ensure that large debris are pushed away from the monolithic housing 215 as the robot 100 navigates across the cleaning surface. In some implementations, the raking prows are curved around a portion of the cleaning extractor 265 for added protection.

The robot 100 includes wheels 225, 230 for supporting the robot 100 on the cleaning surface. The wheels 225, 230 are part of a drive system of the robot 100. The wheels 225, 230 are used to move the robot 100, such as for autonomous navigation. The wheels 225, 230 extend through the bottom portion of the robot 100 and are affixed to the robot 100 with suspension systems. The wheels 225, 230 are disposed in wheel wells, such as well 235, that provide room for the wheels to pivot on the body of the robot 100 independently of one another. The wheel wells include cavities in the bottom portion of the robot 100. The wheel wells are positioned such that the cleaning head 200 is between the wheel wells and the leading edge 125 of the robot 100. The wheels 225, 230 include a material, such as rubber, plastic, and the like, that enables the wheels 225, 230 of the robot 100 to grip the cleaning surface and drive the robot 100 across the cleaning surface. In some implementations, the wheels 225, 230 are modular, so that they can be easily replaced. The drive system drives the wheels 225, 230 such that the cleaning head 200 can engage the cleaning surface and cause a negative pressure on the cleaning surface without the robot 100 getting stuck in place.

In some implementations, a caster 240 can provide support for the robot 100 in addition to the wheels 225, 230. The caster 240 rides on the cleaning surface and can swivel and rotate. In some implementations, the caster 240 is placed near the trailing edge 130 of the robot 100 to support the aft portion 115 of the robot 100 opposite the cleaning head 200. The cleaning head 200 is cantilevered near the forward portion of the robot 100 across the wheels 225, 230. In one implementation, the caster 240 acts as the cantilever and completes the cantilevered support of the cleaning head 200 across the wheels 225, 230. When the robot 100 approaches a first surface (e.g., a soft surface) from a second surface (e.g., a hard surface), the forward portion 110 tilts away from the first surface and the cleaning head 200 drops to engage the first surface. The wheels 225, 230 move to accommodate the change in surface height. The monolithic housing 215 transitions to the first surface from the second surface and maintains close contact or floating contact during the transition. When the robot 100 approaches a second surface (e.g., a hard surface) from a first surface (e.g., a soft surface), the forward portion 110 tilts toward the second surface, and the monolithic housing 215 retracts to engage the second surface. The wheel 225, 230 move to accommodate the change in surface. The monolithic housing 215 transitions to the second surface from the first surface and maintains close contact or floating contact during the transition, as described in greater detail in relation to FIGS. 13-14, below.

The robot 100 can navigate over the cleaning surface autonomously. During nominal navigation, the leading edge 125 of the robot 100 is the first portion of the robot 100 to cross over a portion of the cleaning surface. The rotating cleaning extractors 265, 270 engage against the surface to sweep up any debris on the cleaning surface. The wheels 225, 230 and the caster 240 contact portions of the cleaning surface that have already been passed over by the cleaning head 200. In some implementations, the robot 100 may need to turn. The robot 100 can turn in place by rotating the wheels 225, 230 in opposing directions. In some implementations, the robot 100 can move in reverse. In addition, the source of negative pressure in the cleaning head 200 (e.g., blower 430 of FIG. 4), can be turned off if the cleaning surface is found to be clean, the robot 100 is not performing cleaning operation (e.g., is returning to a base for recharging, etc.), or the robot 100 is determined to be stuck or performing particular maneuvers, etc.

FIG. 4 is a schematic side view cutaway of the robot 100 showing an approximate airflow path 435 through the robot 100 (as marked by a dashed line). The airflow path includes a pneumatic pathway though the robot 100 in which a negative pressure (e.g., a vacuum pressure) can be generated for cleaning operation. The airflow path can extend from the cleaning surface proximate the cleaning extractors 265, 270, through the robot 100, and out a vent in the robot 100. The airflow path is strong enough to carry debris into the robot 100 from the cleaning surface.

A blower 430 can be used to generate the negative pressure inside the robot 100 and create a suction for cleaning operation. For example, the blower 430 can include a vacuum source or impeller. The blower 430 creates a negative pressure in the airflow path. The blower 430 blows air from the airflow path out a vent (not shown) in the robot 100 to create the negative pressure inside the robot 100. The blower 430 pulls air into the robot 100 from the cleaning head 200. Debris that are present on a cleaning surface near the cleaning head 200 are sucked into the cleaning head 200 and into the airflow path. The airflow path passes through bin 415 for collecting the debris and a through a filter 425 for cleaning the debris-laden air, trapping the debris in the bin of the robot 100. The air expelled from the robot 100 by the blower 430 is approximately free of debris. The blower 430 can be located near the aft portion 115 of the robot 100. In some implementations, the blower 430 creates an airflow of 15-20 air watts. In some implementations, the blower 430 creates an airflow of more than 20 air watts.

The airflow path passes from the monolithic cleaning head 215, through a diaphragm 410, through a rigid duct 405, through the bin 415 and the filter 425 inside the bin 415, and through the blower 430 out the aft portion 115 of the robot 100. The rigid duct 405 is formed of a rigid or semi-rigid material. The diaphragm 410 provides a flexible conduit from the monolithic housing 215 to the rigid duct 405, allowing the monolithic housing 215 to move independently of the rigid duct 405 without air leakages or air loss from the airflow path.

The rigid duct 405 forms a conduit that allows air to pass through from one end of the rigid duct 405 to the other end of the rigid duct 405. The rigid duct 405 does not allow air to leak out the sides of the duct when passing from one end of the duct the other end. The rigid duct 405 is mounted on the frame 205 of the cleaning head 200 with a seal formed to the diaphragm 410. In some implementations, screws are used to mount the rigid duct 405 to the frame 205. In some implementations, the rigid duct 405 includes a piezoelectric dirt debris sensor (such as sensor 1535 of FIG. 15) and is angled to guide particulate matter toward the bin entrance. The rigid duct 405 seals with an intake port (e.g., intake port 510 of FIG. 5) of the bin 415. In some implementations, the intake port 510 of the bin 415 presses firmly against the rigid duct 405 when the bin is inserted in the robot 100.

Figure 5:
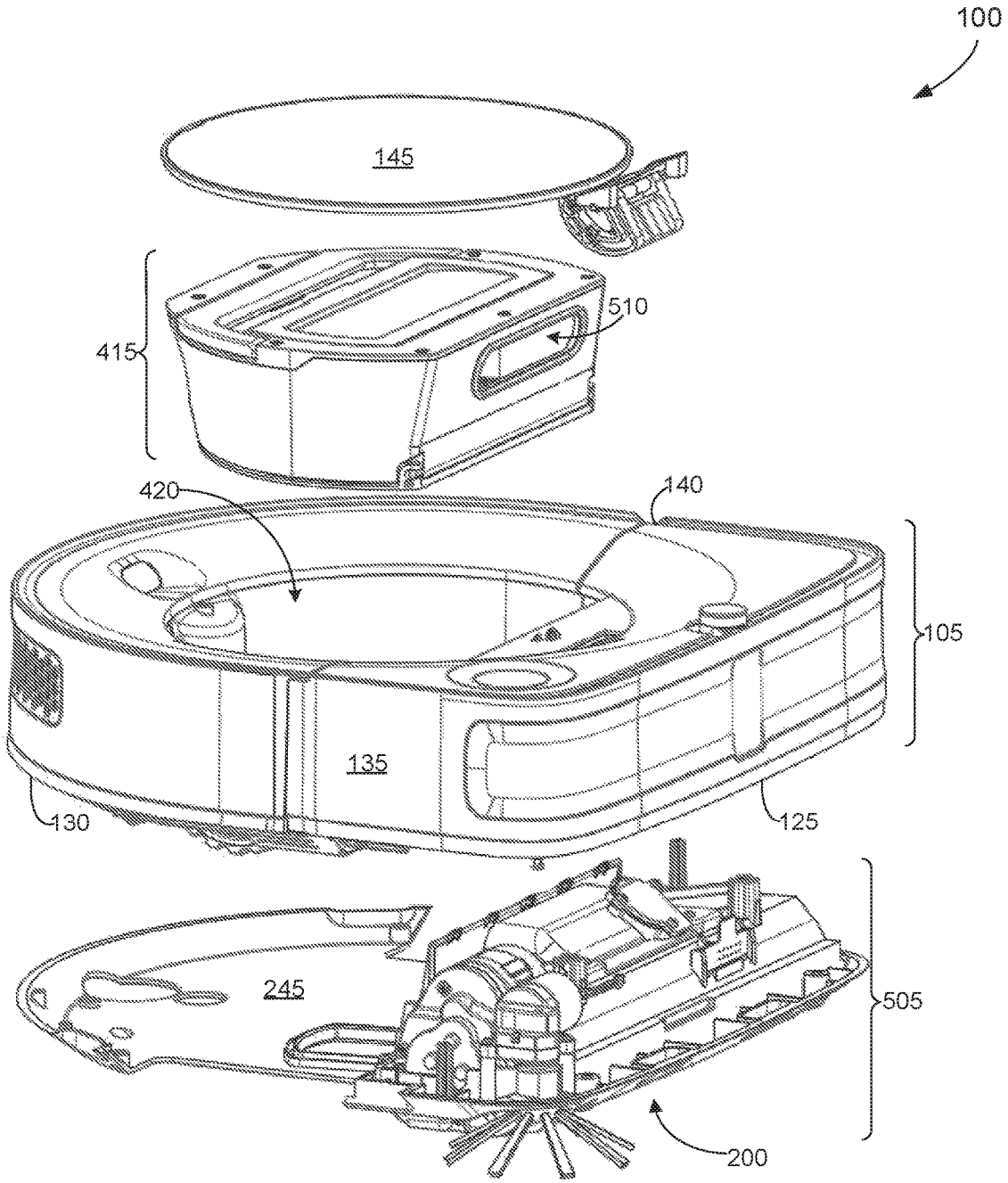
FIG. 5 is an exploded perspective top view of the mobile cleaning robot of FIGS. 1-4.

FIG. 5 shows an exploded view of the robot 100. The robot 100 includes the lid 145, the bin 415, the robot body 105, and the bottom 505. In some implementations, the bin 415 includes an evacuation port (not shown) and an intake port 510. The intake port 510 includes an aperture with a conformable seal around an edge of the aperture. The seal compresses against the rigid duct 405 and forms a sealed airway for the airflow path to proceed from the rigid duct 405 to the bin 415 through the intake port 510. The bin 415 is inserted into the bin well 420 of the chassis 310 during cleaning operation.

The bottom 505 of the robot 100 includes the cleaning head 200 and the aft cover 245. The aft cover 245 abuts with the frame 205 of the cleaning head 200 to complete the bottom 505 of the robot 100.

Figure 6:
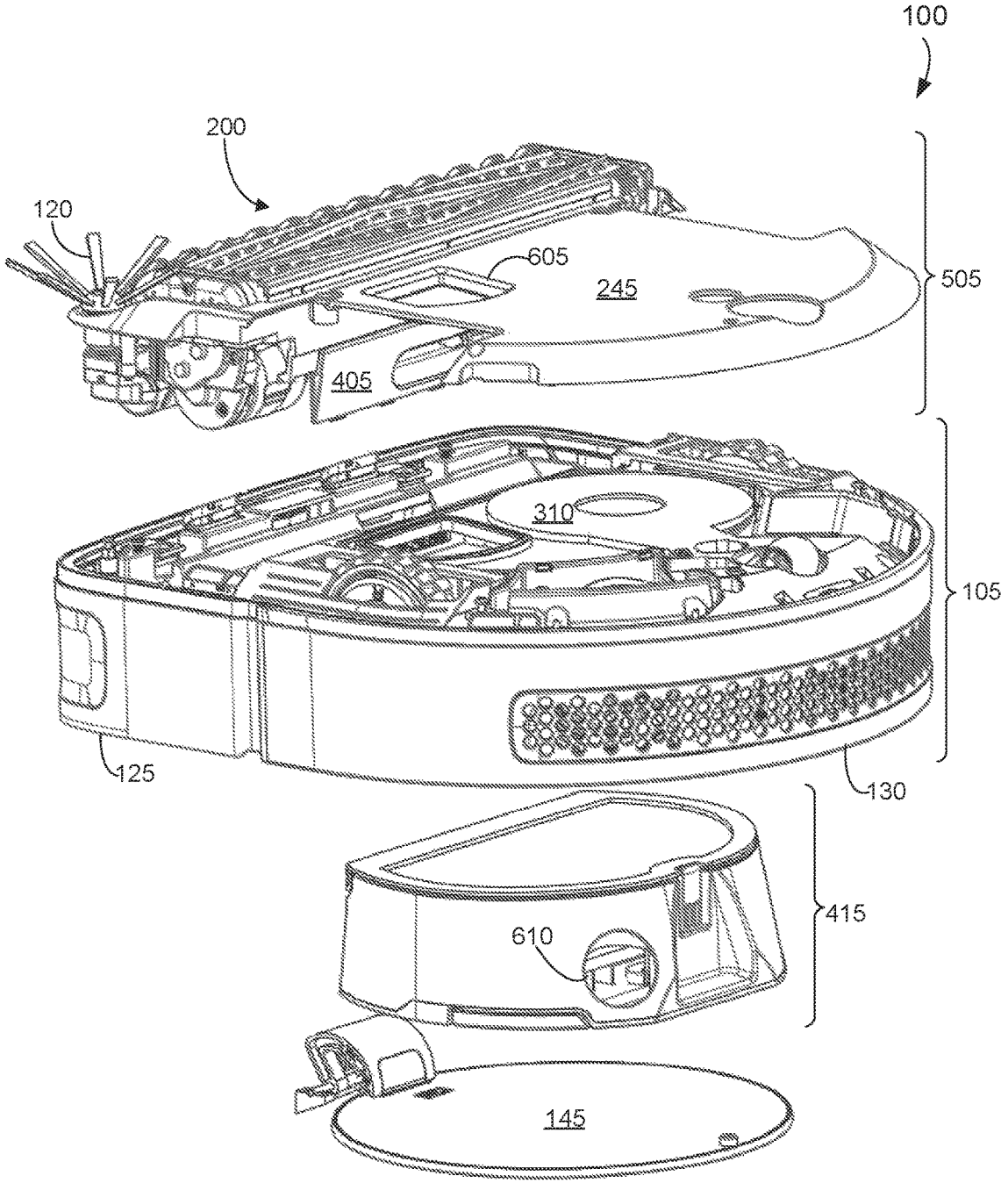
FIG. 6 is an exploded perspective side view of the mobile cleaning robot of FIGS. 1-5.

FIG. 6 shows an exploded upside down view of an example of the robot 100. The bottom 505 of the robot 100 includes the aft cover 245 and the cleaning head 200. The aft cover 245 includes an evacuation aperture 605 for external evacuation of the bin 415. The bin 415 includes an exhaust port 610 through which air that has been cleaned of debris is expelled from the bin 415 and through the blower 430.

FIG. 7 shows the assembly of the bottom 505 of the robot relative to the chassis 310. The chassis 310 forms a framework/skeleton to which other components of the robot 100 are mounted. For example, the frame 205 of the cleaning head 200 is fastened to the chassis 310. The aft cover 245 is fastened to the chassis 310. The chassis 310 includes the bin well 420 in which the bin 415 is placed during cleaning operation of the robot 100.

FIG. 8 shows an exploded view of the cleaning head 200. The cleaning head 200 includes the frame 205, the monolithic housing 215, the diaphragm 410, the rigid duct 405, a corner brush motor 805, the cleaning extractors gearbox 220, a cleaning extractor motor 810, and the cleaning extractors 265, 270. The frame 205 is mounted to the chassis 310 of the robot 100, and the frame 205 supports the other components of the cleaning head 200. The corner brush motor 805 and cleaning extractor motor 810 and gearbox 220 are mounted on the frame 205. The diaphragm 410, which is attached to the monolithic housing 215, extends through the frame 205 and engages screw bosses 815*a-d* with holes 835. Housing carriers 825*a-b* extend through the frame 205 across from frame carriers 820*a-b*, respectively. The housing carriers 825*a-b* and the frame carriers 820*a-b* form a portion of the suspension linkage 1600, described below with reference to FIGS. 13-14 and 16. The rigid duct 405 is mounted on top of the frame 205, such as with screws that engage screw bosses 815*a-d*. The rigid duct 405 and frame 205 compress an extension 830 of the diaphragm to seal the airflow path between the frame 205 and the rigid duct 405.

The cleaning head 200 includes a corner brush 120. The corner brush 120 extends through the frame 205 (as described above in relation to FIG. 2). The corner brush gearbox and corner brush motor 805 are configured to be above the corner brush 120. Such a configuration allows an axle of the corner brush 120 to be within five centimeters of the squared-off corner of the robot 100, enabling the corner brush 120 to extend beyond the perimeter of the robot 100. In some implementations, the corner brush 120 is between 1-2 cm from the squared-off corner of the robot 100.

The cleaning head 200 includes the cleaning extractor motor 810 for turning the one or more cleaning extractors 265, 270. The cleaning extractor motor 810 can be mounted near a lateral edge of the cleaning head 200. The cleaning extractor motor 810 is mounted on top of the monolithic housing 215 of the cleaning head 200. The cleaning extractor motor 810 placement allows for the monolithic housing 215 to extend further across the lateral width 150 of the robot 100 than if the cleaning extractor motor 810 were placed in-line with the monolithic housing 215.

The cleaning extractor motor 810 couples to cleaning extractor gearbox 220 that is mounted on a lateral end of the monolithic housing 215. The cleaning extractor gearbox extends less than three centimeters from the lateral end of the monolithic housing 215. In some implementations, the cleaning extractor gearbox is a two stage gearbox. The cleaning extractor gearbox is coupled to an output gear for each cleaning extractor of the cleaning extractors 265, 270. During cleaning operation, the cleaning extractor motor 810 receives an electric current and, through the gearbox, spins the output gears. In some implementations, the torque of the cleaning extractor motor 810 is divided approximately equally between each output gear. In some implementations, the torque of the cleaning extractor motor 810 is greater for one of the cleaning extractor than the other (e.g., biased 65% for cleaning extractor 265 and 35% to cleaning extractor 270). The cleaning extractors 265, 270 are disposed in the output gears and rotate to sweep up debris from the cleaning surface into the airflow path. The cleaning extractor gearbox includes an extended bell housing to prevent debris, such as hair, from becoming entangled in the gearbox. The configuration of the output gears is described in greater detail in relation to FIG. 15, below.

Figure 9:
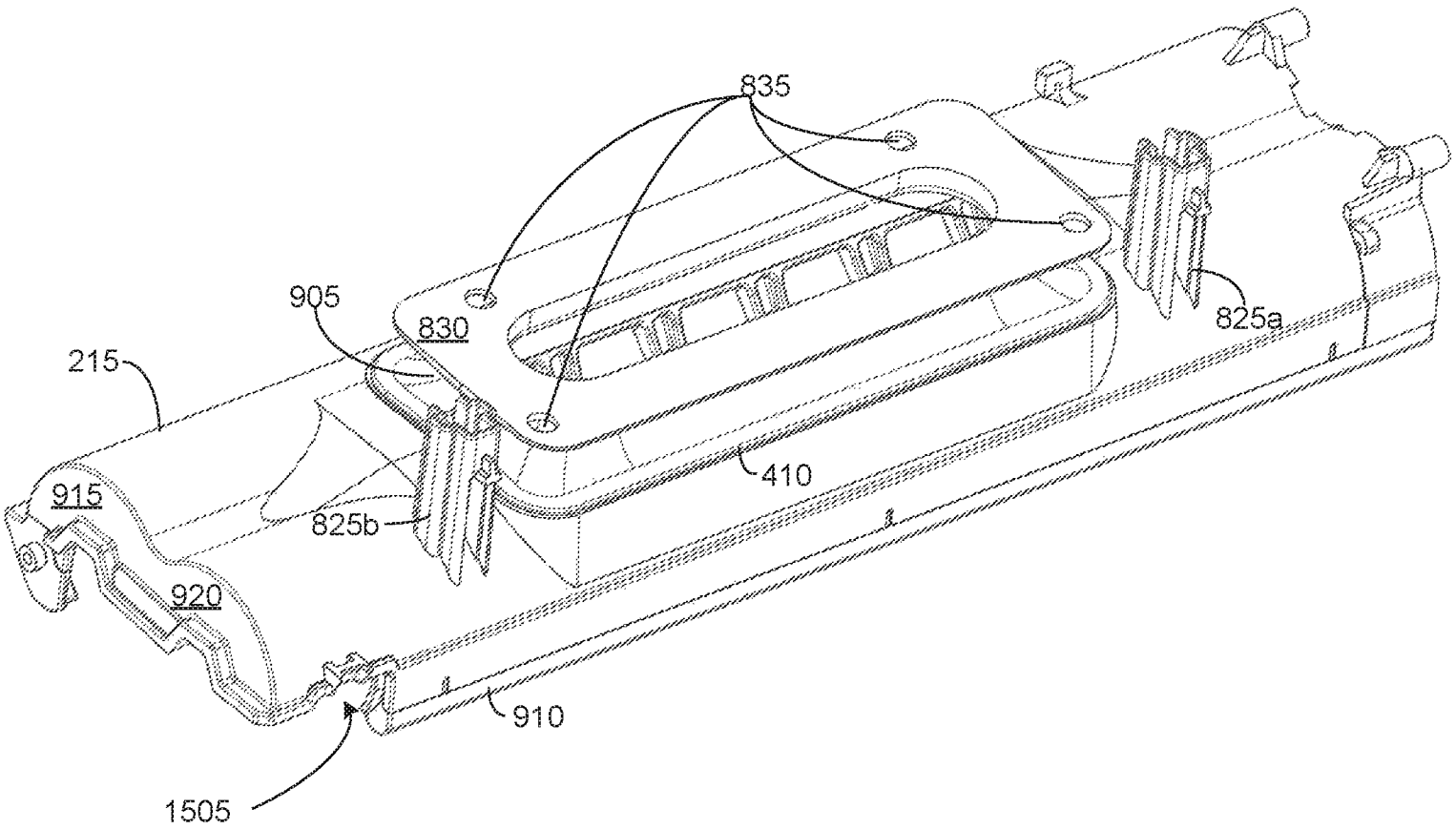
FIG. 9 is a perspective view of an example monolithic housing and a diaphragm of the mobile cleaning robot of FIGS. 1-7.

FIG. 9 shows a perspective view of the monolithic housing 215 assembled with the diaphragm 410. The monolithic housing 215 is constructed from a single molded piece of rigid material shaped to conform an interior cavity (e.g., interior cavity 1505 of FIG. 15) to a shape of the cleaning extractors 265, 270 disposed in the interior cavity. The monolithic housing 215 includes a first sub-cavity 915 and a second sub-cavity 920 which each receive a cleaning extractor 265, 270, respectively, for cleaning operation. The housing linkage carrier 825*a* and a second housing linkage carrier 825*b* are molded from the same single piece as the monolithic housing 215. The monolithic housing 215 includes housing carriers 825*a-b* that form a portion of a suspension linkage 1600 for suspending the monolithic housing 215 from the frame 205.

In some implementations, a trailing edge of the monolithic housing 215 includes the flexible barrier 910. The flexible barrier 910 extends along the lateral axis of the monolithic housing and extends from the monolithic housing 215 to the cleaning surface. The flexible barrier 910 is affixed to the trailing edge of the monolithic housing 215 to reduce air gaps between the monolithic housing 215 and the cleaning surface and increase the airflow velocity at the opening of the monolithic housing 215. As such, the flexible barrier 910 helps to reduce the amount of debris that is missed or passed over by the robot 100 during cleaning operation.

The monolithic housing is formed from a single piece of material. Forming the monolithic housing 215 from a single piece simplifies manufacturing and reduces or eliminates assembly seams and gaps that can trap debris or permit air leaks in the cleaning head 200. Additionally, durability of the monolithic housing 215 can be increased. For example, the housing carrier 825*b* need not be bolted, glued, or otherwise affixed to the monolithic housing 215, which can cause a point of structural weakness or create air gaps.

The diaphragm 410 includes a diaphragm body 905 and the diaphragm extension 830. The diaphragm extension 830 includes the holes 835 that provide clearance for the screw bosses 815*a-d* of the frame 205, shown in FIG. 8. The rigid duct 405 fastens to the frame 205 with the screw bosses 815*a-d* to form the first seal (e.g., first seal 1205 of FIG. 12) between the rigid duct 405 and the diaphragm 410.

Figure 10:
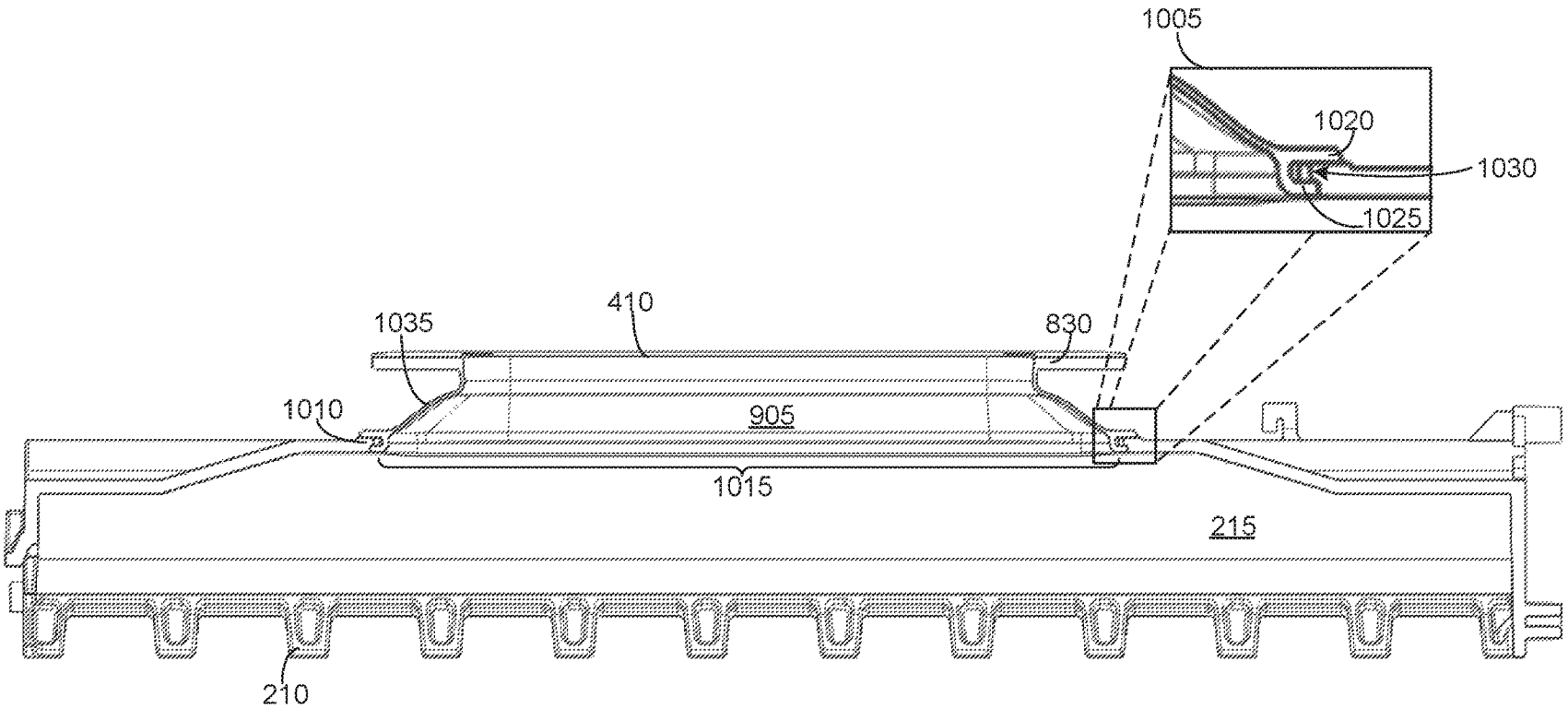
FIG. 10 is a side view of the monolithic housing and the diaphragm of the mobile cleaning robot of FIGS. 1-7.

FIG. 10 shows a front view of the monolithic housing 215 assembled with the diaphragm 410. The monolithic housing 215 includes a lip 1010 for forming a second seal 1005. The lip 1010 is formed from the same single piece of material as the monolithic housing 215. The diaphragm extension 830 is used to form a seal (e.g., first seal 1205 shown in FIG. 12). A second seal 1005 is formed between the monolithic housing 215 and the diaphragm 410. The diaphragm body 905 forms a conduit between the first seal and second seal 1005. Briefly turning to FIG. 14, when the suspension linkage 1600 raises the monolithic housing 215, the diaphragm body 905 translates such that the conduit formed by the diaphragm 410 between the rigid duct 405 and the monolithic housing 215 is shortened. The diaphragm body wall 1035 translates when the suspension linkage 1600 is raised such that the cross section airflow path through the diaphragm 410 does not decrease appreciably to affect the cleaning performance of the robot 100. The diaphragm wall 1035 does not pucker or fold when the suspension linkage 1600 raises and lowers the cleaning head 200, but remains taut. In some implementations, the diaphragm body wall 1035 is between 0.5-1.5 mm thick.

Figure 11A:
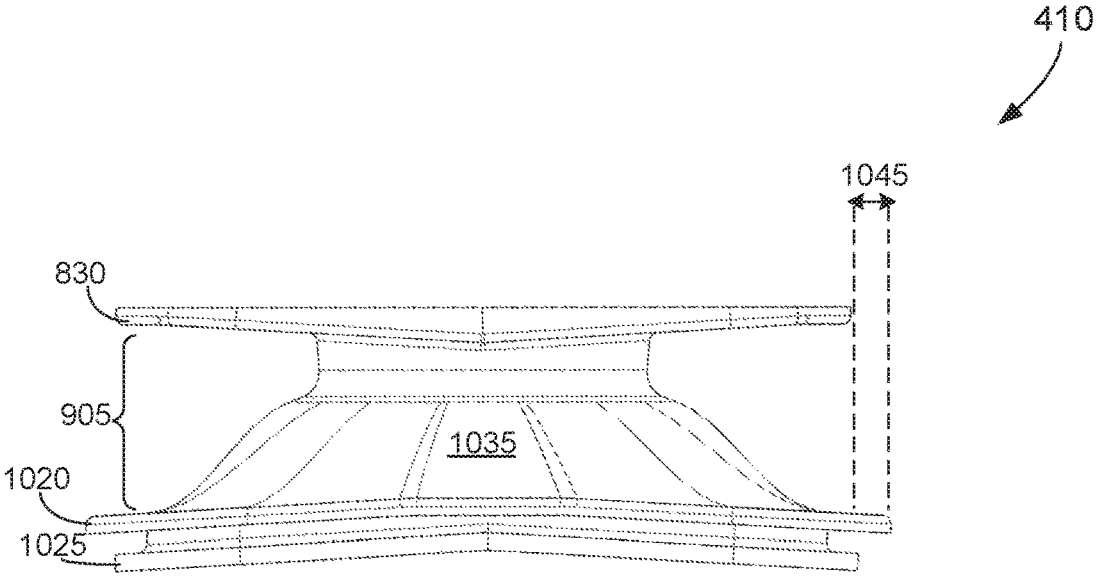
FIG. 11A is a side view of the diaphragm of the mobile cleaning robot of FIGS. 1-7.
Figure 11B:
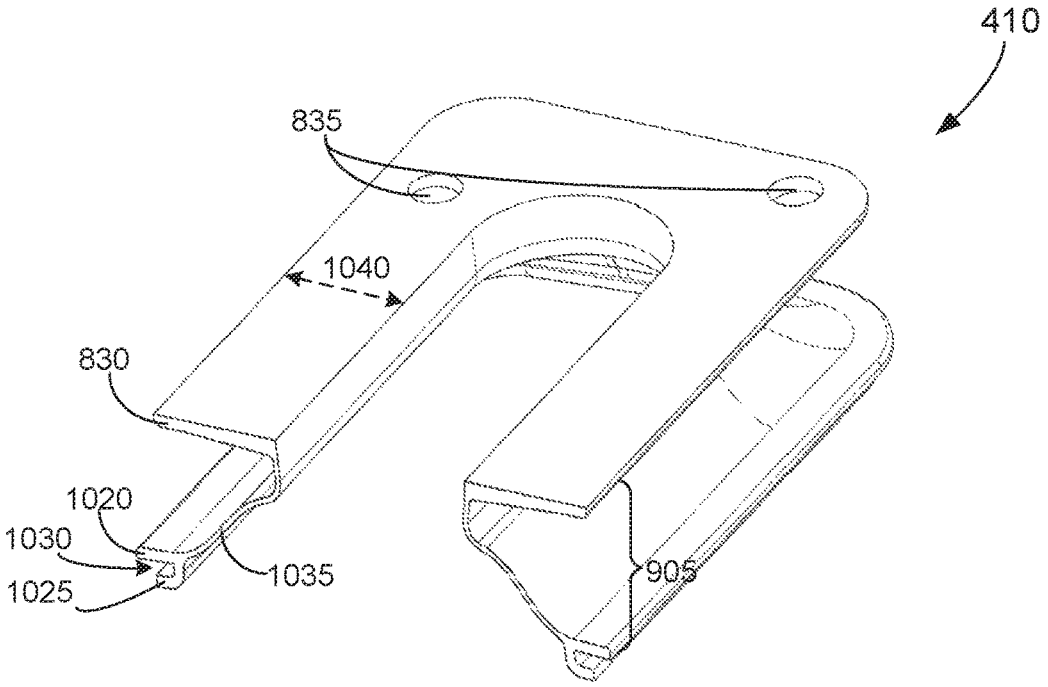
FIG. 11B is a perspective view of the diaphragm of the mobile cleaning robot of FIGS. 1-7.

Turning to FIGS. 10 and 11A-11B, the diaphragm extension 830 extends from the diaphragm 410 to form the first seal of the diaphragm 410. The diaphragm extension 830 extends in a substantially planer way from the diaphragm body 905. The diaphragm extension 830 is mechanically compressed between the rigid duct 405 and the monolithic housing 215 to form the first seal 1205. Screws, or other fastening mechanisms, can be extended through apertures in the diaphragm extension 830 such as holes 835.

In some implementations, the diaphragm extension 830 is 10-15 mm wide as shown by length 1040 and overlaps the top of the frame 205 to mate securely against the rigid duct 405. In some implementations, the extension 830 extends to within 5 mm of the outer perimeter of a double flange of the second seal 1005 as shown by length 1045. The size of the extension 830 ensures adequate retention force under complete vertical translation and retraction positions of the cleaning head 200. The diaphragm extension 830 is formed to reduce modes of failure because fewer or no stress concentrations are built up around perforations or attachment holes in the extension. Stress concentrations can reduce tearing or releasing of the diaphragm 410 from the cleaning head (e.g., pulling off of posts). The rigid duct 405 includes a knife-edge seal that presses into the diaphragm extension 830 to complete the first seal 1205.

Figure 12:
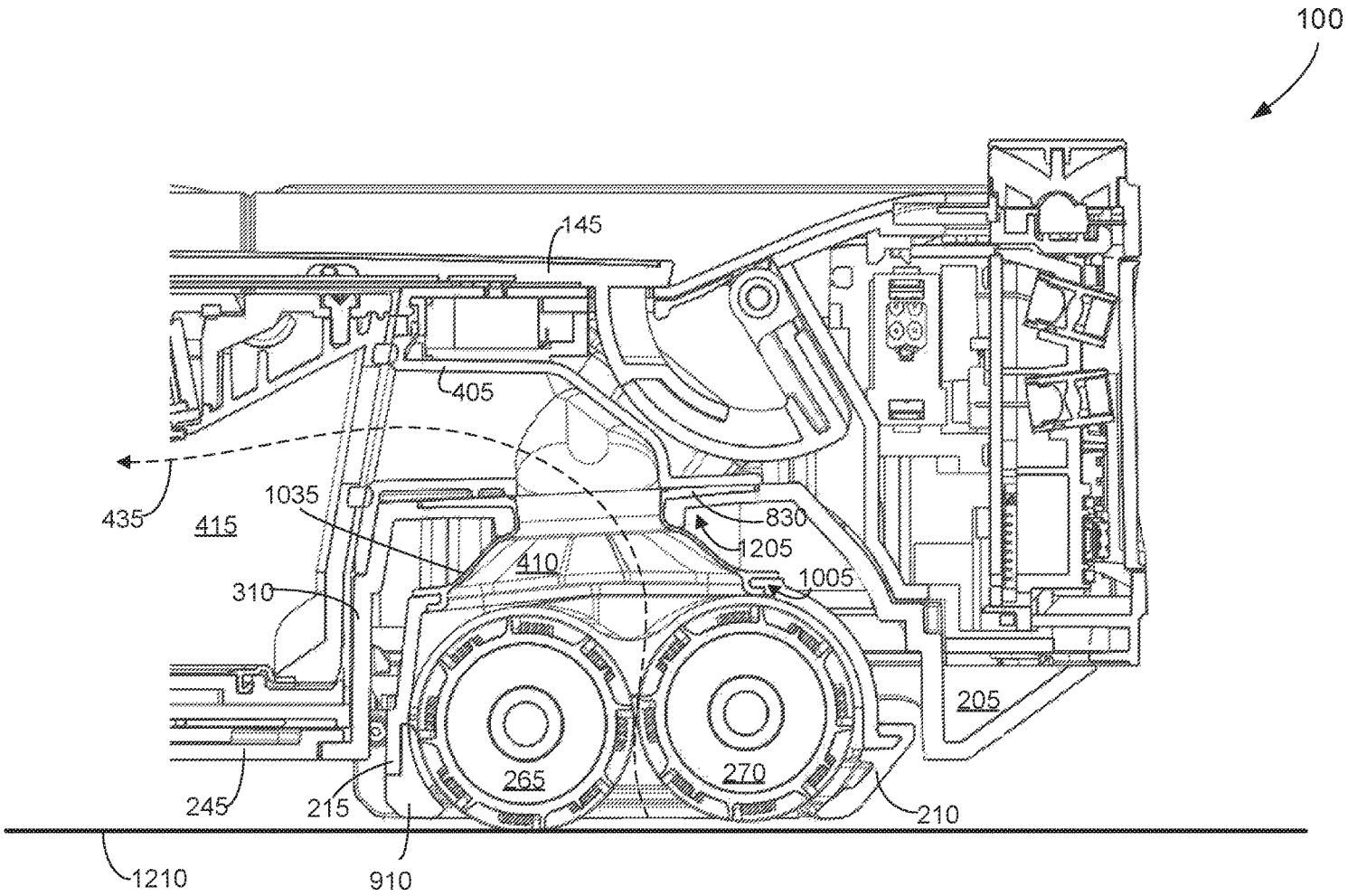
FIG. 12 is a side-view of a portion of the mobile cleaning robot of FIG. 4.

Turning to FIG. 12, the diaphragm 410 mates with the monolithic housing 215 using the second seal 1005 that wraps around an aperture 1015 in the monolithic housing. The diaphragm 410 is molded to fit over the lip 1010 of the aperture 1015 of the monolithic housing 215 to create the second seal 1005. The second seal 1005 includes a double flange configuration. The double flange configuration seals the diaphragm 410 to the monolithic housing 215 using a top flange 1020 and a bottom flange 1025. The top flange 1020 and the bottom flange 1025 sandwich a receiving channel 1030 in the diaphragm 410. The receiving channel 1030 receives a lip 1010 of the aperture 1015 of the monolithic housing 215. The bottom flange 1025 extends through the aperture 1015 of the monolithic housing 215 over the lip 1010 of the aperture into the interior cavity 1505 of the monolithic housing. The second seal 1005 forms an airtight seal of the monolithic housing 215 wherein the second flange is inside the interior cavity 1505 and guiding the lip 1010 of the aperture into the receiving channel 1030 of the diaphragm 410.

In some implementations, the second seal 1005 on the bottom of the diaphragm 410 forms an airtight seal and robust retention feature, simultaneously. The lip 1010 of the diaphragm 410 is overmolded firmly in place with equal force around a smooth opening (e.g., a rounded ellipse rather than an angled trapezoid) with no perforations that could cause points of failure under stress concentration. In some implementations, the diaphragm 410 is overmolded onto the monolithic housing 215 to form the second seal 1005. The overmolding process creates a "plastic weld" that chemically mates the diaphragm 410 and the monolithic housing 215. In some implementations, the diaphragm includes a TPE plastic. In some implementations, the monolithic housing 215 includes a PCABS plastic. The overmolding process chemically binds the TPE plastic to the PCABS plastic to create an airtight seal.

The diaphragm 410 affixes to the interior cavity 1505 of the monolithic housing 215 without a lip or protrusion that might disrupt laminar airflow through the diaphragm to the rigid duct 405. In some implementations, a cross-section of the airflow path through the diaphragm body 905 can decrease in size from the second seal 830 to the first seal 1205. This configuration can accelerate the airflow in the diaphragm 410 as the debris is moved from the cleaning surface to the bin 415. The smooth transition limits losses due to eddies in the airflow. The increased velocity of the airflow path can enable more effective debris transfer to the bin 415 from the cleaning surface.

Returning to FIG. 11A, a perspective view of the diaphragm 410 is shown. The top flange 1020, the bottom flange 1025, and a diaphragm extension 830 are shown in greater detail. The diaphragm body wall 1035 translates when the suspension linkage 1600 is raised (e.g., as seen in FIG. 14). The diaphragm body wall 1035 conforms without blocking airflow, reducing a cross section of the airflow path (e.g., a pneumatic path), and without compressing or stretching the diaphragm material, as described in greater detail in relation to FIGS. 13-14, below. The first seal (e.g., first seal 1205 of FIG. 12) includes the extension 830, or flange, of the diaphragm 410 compressed between the rigid duct 405 and the chassis 310. The first seal 1205 is conformable between the rigid duct 405 and the chassis 310. As described above, because the rigid duct 405 can be fixed to the chassis 310 using screws, the diaphragm 410 includes one or more holes 835 in the extension for allowing the screws to pass through the first seal 1205 of the diaphragm from the rigid duct 405 to the chassis 310. Sealing the diaphragm 410 using the first seal 1205 can eliminate the need for adhesive and increase the modularity of the robot 100. For example, the monolithic housing 215 can be removed from the robot 100 without needing to replace adhesive and without risking tearing the diaphragm 410. FIG. 11B shows an alternative view of the diaphragm 410 including the diaphragm body 905 and diaphragm body wall 1035, diaphragm extension 830, top flange 1020, and bottom flange 1025.

In some implementations, the diaphragm 410 includes a plastic material, such as TPE, TPV, SEBS, or Thermoplastic Elastomers. In some implementations, the plastic material is non-static or anti-static such that lint, hair and other light debris are repelled or do not stick. In some implementations, the diaphragm 410 has minimal tackiness, such as that of materials like Silicon. The plastic material can be 0.5-1.0 mm thick. In some implementations, the thickness of the plastic is calibrated so that the diaphragm 410 has an appropriate stiffness for floating the cleaning head 200 above or on a cleaning surface. In some implementations, the stiffness of the material is 20-60 Shore A. In some implementations, the stiffness of the diaphragm 410 is such that the diaphragm imparts minimal resistance to the vertical movement of the monolithic housing 215. Briefly turning to FIGS. 13-14, the shape of the diaphragm is such that the material does not "pucker" when the cleaning head 200 moves using the suspension linkage 1600. Rather the diaphragm 410 is molded with smooth, curved sidewalls that expand and contract, such as a single fold of a bellows, without producing any sharp edges or deep indentations in which debris might lodge instead of smoothly bouncing up into the rigid duct 405. In some implementations, the diaphragm includes a serpentine diaphragm body wall 1035 design that assists with the spring action. The design of the diaphragm body wall 1035 is such that the cleaning head 200 requires minimal force for translating toward and away from the cleaning surface using the suspension linkage 1600. The design of the diaphragm body wall 1035 limits changes to airflow path through the diaphragm 510 during suspension linkage 1600 movement. In some implementations, the diaphragm shape provides trivial vertical resistance on the diaphragm between the top flange 1020 and bottom flange 1025. The diaphragm shape provides a lateral stiffness in which the wall moves one eighth of the distance of vertical travel, resisting debris entrapment in diaphragm 410 folds.

The shape diaphragm 410 facilitates assembly. In some implementations, the diaphragm 410 can fold up through the frame opening and loop over screw bosses of the frame 205 during assembly, and be compressed and sealed by the rigid duct 405. The diaphragm extension 830 is compressed much more under high pressures, providing a better seal than a plastic-on-plastic, or a rubber-on-rubber seal.

Turning to FIG. 12, which shows a magnification of the robot 100 of FIG. 4, a diaphragm 410 is disposed in the airflow path 435 for connecting the rigid duct 405 to the monolithic housing 215 of the suspended cleaning head 200. The diaphragm 410 forms a pneumatic conduit that connects the rigid duct 405 and the monolithic housing 215 to form a single continuous airflow path (e.g., a pneumatic path) from the cleaning head 200 near the cleaning surface 1210 to the blower 430. The diaphragm 410 flexes to accommodate the relative movement between the cleaning head 200 and the robot body 105. The diaphragm permits the monolithic housing 215 to follow the undulations of the cleaning surface independent of the movement of the robot body 105 while maintaining a seal of the airflow path from the cleaning head 200 to the bin 415. For example, when engaging a soft surface (e.g., a carpet), the cleaning head 200 floats up and the diaphragm 410 is flexed into a smooth and continuous serpentine shape around the frame 205 that does not fold and entrap debris. In another example, when engaging a hard surface (e.g., a wood floor), the cleaning head 200 lowers and the diaphragm 410 is extended. The floating behavior of the cleaning head 200 increases the suction from the cleaning head 200 on the cleaning surface because air gaps that allow air leaks in the airflow path are reduced or eliminated, such as gaps between the monolithic housing 215 and the cleaning surface 1210.

The airflow path continues through the diaphragm 410 and into the monolithic housing 215. The monolithic housing 215 includes the interior cavity 1505. The interior cavity 1505 is configured to minimize leaks in the airflow path. The interior cavity 1505 forms a shell around the cleaning extractors 265, 270 and permits airflow between the aperture 1015 of the interior cavity 1505 and into the diaphragm 410 from an open end which faces the cleaning surface. The monolithic housing 215 and interior cavity 1505 are described in greater detail in relation to FIG. 15.

The cleaning surface is exposed to the airflow path through open end of the interior cavity 1505, which begins the airflow path through the robot 100. During cleaning operation, the portion of the cleaning surface that is exposed to the cleaning extractors 265, 270 experiences a negative pressure generated by the blower 430. Air that is sucked through the airflow path between the cleaning extractors 265, 270 enters the interior cavity 1505 of the monolithic housing 215. The airflow path is guided into the diaphragm 410 that is mated with the interior cavity 1505 of the monolithic housing 215 as described above because the interior cavity 1505 includes a solid shell.

Figure 13:
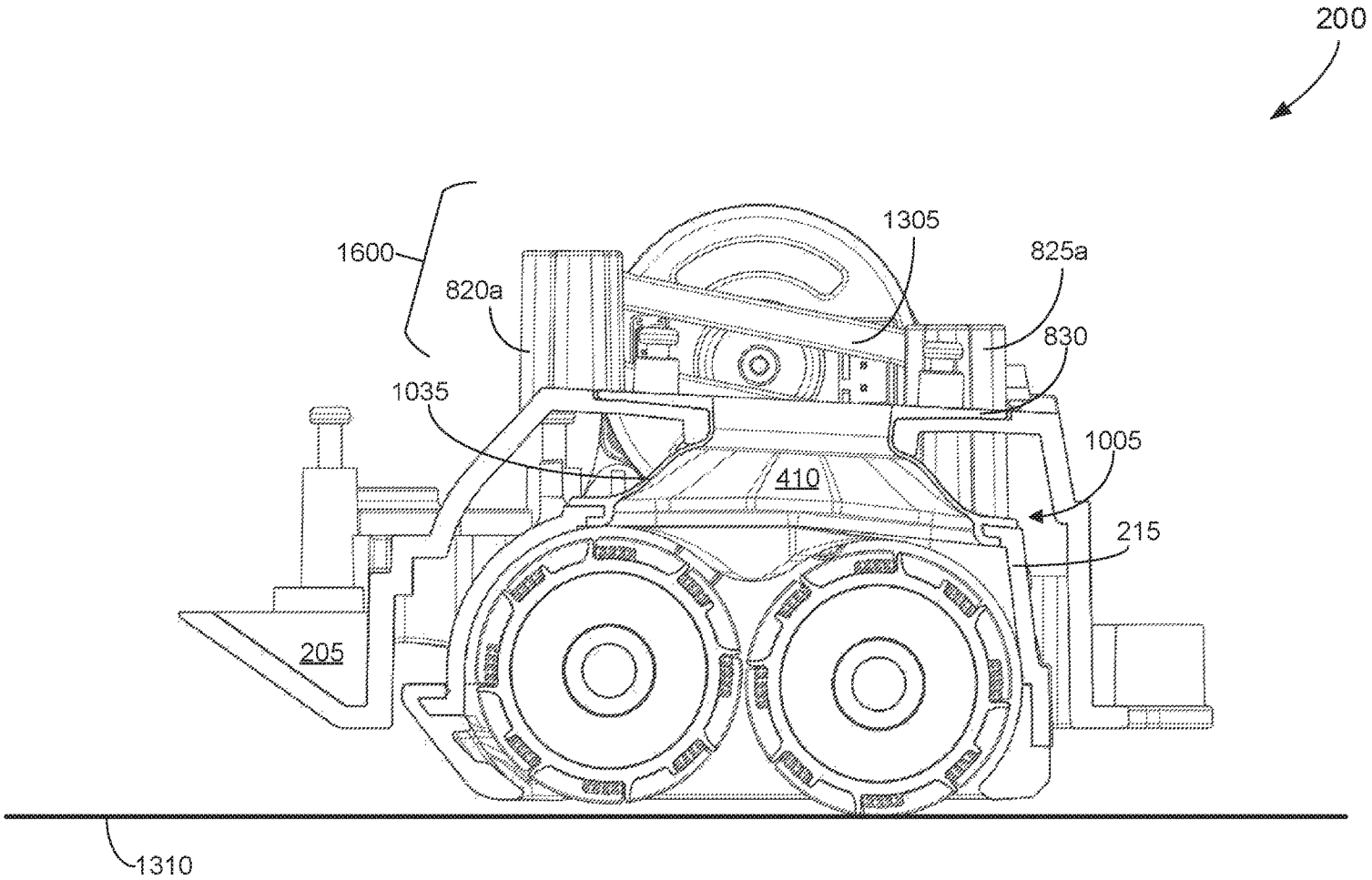
FIG. 13 is side cutaway view of the example cleaning head of FIG. 8 in an extended position.
Figure 14:
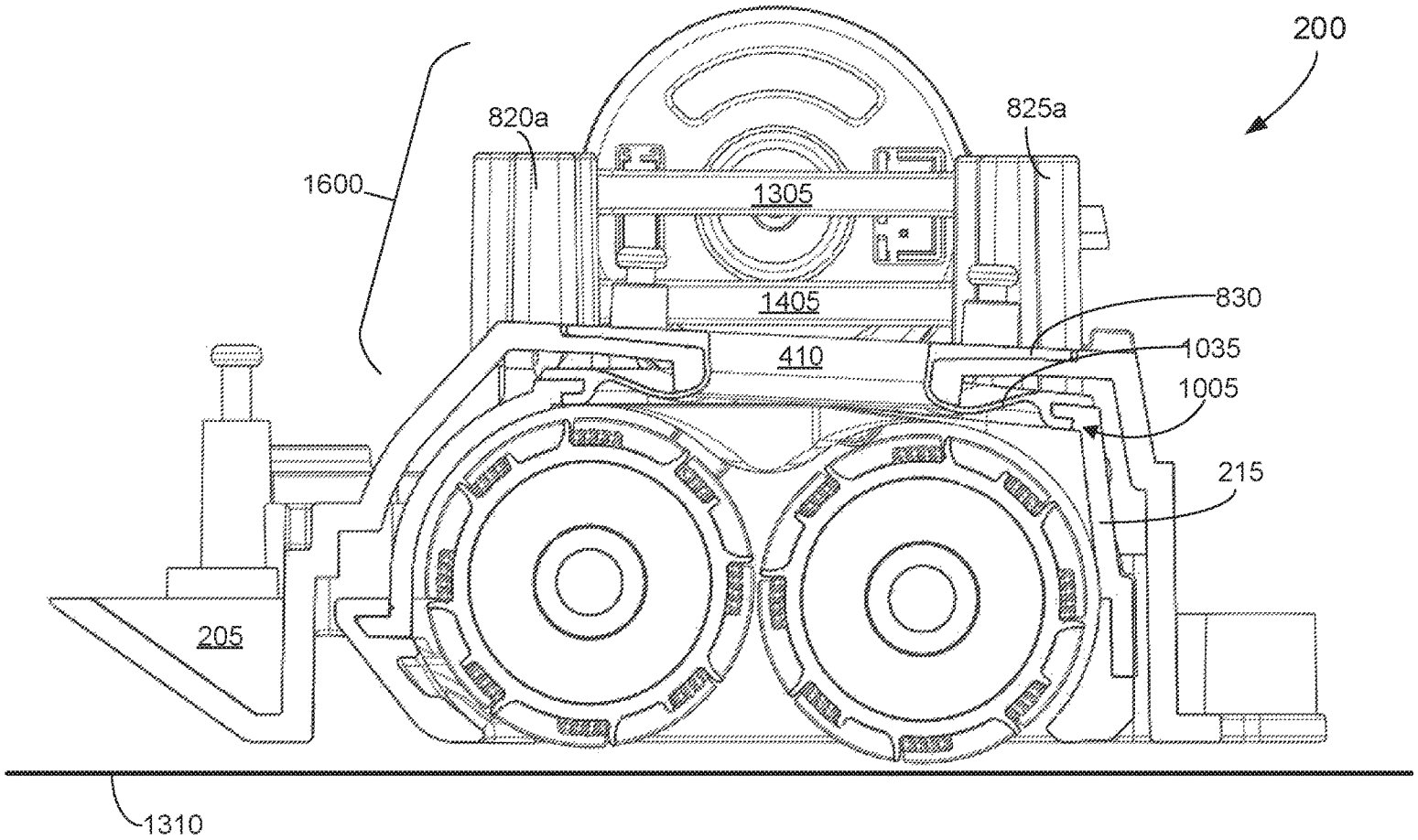
FIG. 14 is side cutaway view of the example cleaning head of FIG. 8 in a retracted position.

FIG. 13 is side-view of a portion of the cleaning head 200 showing the suspension linkage 1600 for raising and lowering a monolithic housing 215 relative to the cleaning surface 1310. Suspension links, such as suspension link 1305 (which may also be suspension link 1610*a* of FIG. 16), are tilted relative to the bottom of the robot 100. In the lowered state, the pivot joints affixing the suspension link 1305 to the housing linkage carriers (e.g., housing linkage carrier 825*a*) are lower than the pivot joints affixing the suspension links to the frame linkage carriers 820*a*, 820*b*. Bottom edges of the cleaning extractors 265, 270 are approximately planar with the bottom of the monolithic housing 215. The monolithic housing 215 extends closer to the cleaning surface 1310 than the frame 205. Thus, the monolithic housing 215 can engage the cleaning surface 1310 and reduce air leakage between the monolithic housing 215 and the cleaning surface. The cleaning extractors 265, 270 engage the cleaning surface 1310 on which the robot 100 is performing a cleaning operation.

The diaphragm 410 can be seen in an extended state between the diaphragm extension 830 and the second seal 1005. The diaphragm body wall 1035 extends to form the airflow path is from the monolithic housing 205 to the rigid duct 405.

FIG. 14 is side-view of the cleaning head 200 showing the suspension linkage 1600 for raising and lowering a monolithic housing 215 in a raised state. The suspension links 1305, 1405 of the suspension linkage 1600 are approximately parallel to the bottom of the robot 100 and to each other. The cleaning extractors 265, 270 are approximately flush with the bottom surface of the robot 100. The monolithic housing 215 is approximately planar with (or retracted into) the frame 205 to engage the cleaning surface 1310.

The diaphragm body wall 1035 forms a smooth serpentine shape between the diaphragm extension 830 and the second seal 1005. The diaphragm body wall 1035 curves so that the second seal 1005 is above or adjacent to the diaphragm body 905. The monolithic housing 215 extends up through the frame 205. The diaphragm 410 thus allows the monolithic housing 215 to pass by the frame 205 while maintaining a sealed airflow path 435 between the monolithic housing 215 and the rigid duct. The movement of the monolithic head 215 past the frame 205 enables the monolithic housing 215 to ride undulations of the cleaning surface 1310, and the diaphragm 410 does not block the airflow path or entrap debris. The diaphragm 410 remains taut while allowing the monolithic housing 215 to ride the cleaning surface 1310. The diaphragm wall 1035 forms the serpentine shape up and around the frame 205 away from the airflow path, rather than deforming, compressing, stretching, or exposing folds to the airflow path. The diaphragm 410 does not obstruct the airflow path, does not compress or stretch, and maintains the first and second seals 1005, 1205. Because the material of the diaphragm 410 does not deform or stretch during operation, a thicker and more durable diaphragm material can be used than if the diaphragm were to deform, compress, or stretch to allow movement of the monolithic cleaning head 215. In some implementations, the diaphragm is distinct from a plenum, which compresses or stretches to allow motion between two objects. Thus, the diaphragm 410 motion characteristics are easier to tune than those of a plenum, the diaphragm 410 is more durable, and the diaphragm 410 does not create obstructions to the airflow path. The diaphragm 410 remains fairly taut in both the extended and folded states. The top of the monolithic housing 215 moves up and through the frame 205 such that the top of the monolithic housing 215 moves above the top of the frame 205.

The rigid duct 405 is fixed to the frame 205 and does not move when the suspension linkage 1600 raises or lowers the monolithic housing 215. The diaphragm 410 is flexible to allow the suspension linkage 1600 to move freely within the range of motion of the suspension linkage and still have a sealed airflow path between the interior cavity 1505 of the monolithic housing 215 and the rigid duct 405. By maintaining a sealed airflow path despite the movement of the cleaning head 200, the airflow velocity is maintained.

Figure 15:
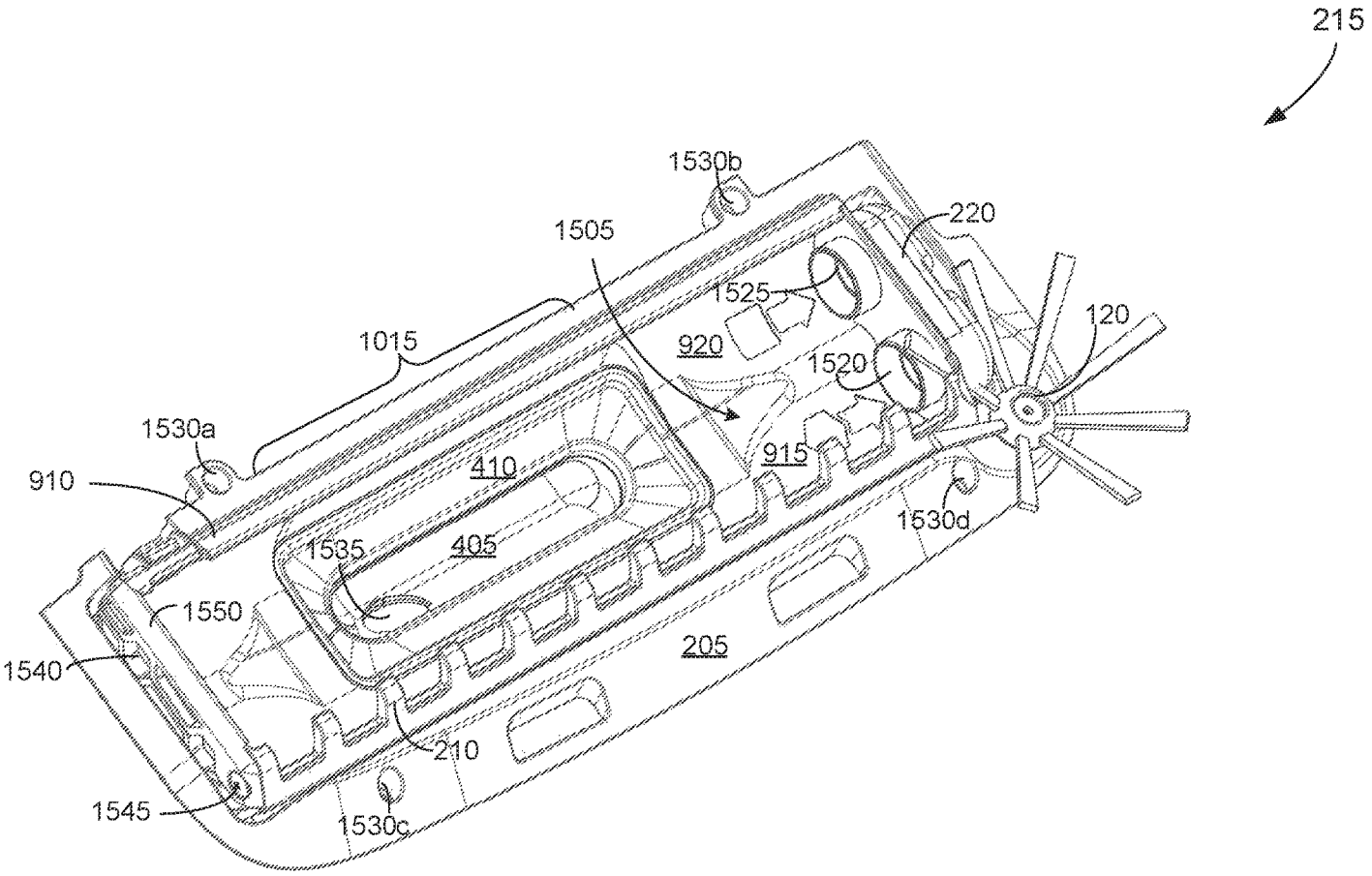
FIG. 15 is perspective bottom view of a portion of the example cleaning head of FIG. 8.

FIG. 15 is perspective view of the cleaning head 200 from below showing the interior cavity 1505 of the monolithic housing 215 and the diaphragm 410. The front edge of the monolithic housing 215 terminates in raking prows 210 for preventing large debris from going underneath the cleaning head 200 as described above. The trailing edge of the monolithic housing includes the flexible barrier 910 to further reduce air leakage between the monolithic housing 215 and the cleaning surface. In some implementations, the flexible barrier 910 can be a rigid, rounded edge. For example, the monolithic housing 215 rides along the contours of the cleaning surface such that the raking prows 210 and the flexible barrier 910 engage the contours of the cleaning surface.

The monolithic housing 215 forms the interior cavity 1505 configured to receive a cleaning extractor or cleaning extractors. The interior cavity 1505 faces the cleaning surface and includes an aperture 1015 that is connected to the diaphragm 410. The interior cavity 1505 of the monolithic housing 215 forms a solid, continuous surface such that debris is not trapped and does not build up against the monolithic housing inside the interior cavity 1505. Additionally, the interior cavity 1505 is formed from a single piece of material to eliminate gaps or assembly seams and allow smooth laminar airflow across the interior cavity 1505. The airflow path causes the interior cavity 1505 to experience a negative pressure that can be used to cause debris lifted from the cleaning surface to pass through the airflow path and though the diaphragm 410 from the cleaning surface. The interior cavity 1505 approximately follows contours of the one or more cleaning extractors 265, 270 and leaves a portion of the one or more cleaning extractors 265, 270 exposed to the cleaning surface.

The monolithic housing 215 is shaped to approximately match the shape of the cleaning extractors 265, 270. The contours guide airflow towards the center of the diaphragm 410. This ensures that the airflow velocity is greatest in the direct path of debris ingestion. In some implementations, if the robot has two cleaning extractors, airflow velocity is greatest between the cleaning extractors 265, 270. In some implementations, the cleaning extractors 265, 270 are tubular rollers that extend along the lateral axis of the monolithic housing 215. The monolithic housing 215 is shaped to fit the tubular rollers such that the interior cavity 1505 has a sub-cavity for each tubular roller that accommodates to the shape of each tubular roller. For example, a first tubular roller (not shown) can be disposed in the arcuate or semi-circular first sub-cavity 915 and a second tubular roller (not shown) can be disposed in the arcuate or semi-circular second sub-cavity 920.

One or more output gears are disposed in the surface of interior cavity 1505. For example, a first output gear 1520 can be disposed proximate to the first sub-cavity 915 and a second output gear 1525 can be disposed proximate to the second sub-cavity 920. Each output gear includes a keyed notch. The notch can be keyed to a shape, such as a hexagon matching the profile of a protrusion of the cleaning extractor. In some implementations, if there is more than one extractor, the shapes for each output gear can be different from other to assist a user in placing the cleaning extractors 265, 270 to correct orientations or positions inside the monolithic housing 215, such as after servicing or cleaning of the cleaning head 200. The notch can be symmetrical or asymmetrical and includes edges for turning a cleaning extractor. The output gears 1520, 1525 are sealed such that there is no air leakage from the edge of the interior cavity 1505 through the output gears 1520, 1525. Each output gear is covered with an extended bell housing to prevent debris, such as hair, from becoming entangled in the extractors.

The cleaning extractor motor 810 drives the output gears and thus rotates the cleaning extractors 265, 270 that are fitted in each output gear. The cleaning extractor motor 810 drives the output gears through the cleaning extractor gearbox 220 mounted on a lateral end of the monolithic housing 215. The cleaning extractor gearbox 220 has a narrow profile to enable the monolithic housing 215 to extend substantially across the lateral axis of the robot 100. In some implementations, the cleaning extractor gearbox 220 extends less than three centimeters from the lateral end of the monolithic housing 215. The narrow configuration of the cleaning extractor gearbox 220 allows the monolithic housing 215 to extend closer to the second side 140 of the robot 100. The corner brush 120 is disposed in front of the cleaning extractor gearbox 220. In some implementations, the corner brush 120 spins to sweep debris from a surface in front of the cleaning extractor gearbox 220 in front of the cleaning extractors 265, 270.

A latch 1550 can secure the cleaning extractors 265, 270 in the monolithic housing 215. In one implementation, the latch 1550 is a spring latch disposed on a lateral end of the interior cavity 1505 opposing the output gears. The latch 150 rotates at hinge 1545 and fastened onto the monolithic housing 215. The latch 1550 includes notches for holding ends of the cleaning extractors 265, 270. The notch allows the cleaning extractor held by the notch to spin in place without vibrating or detaching from the monolithic housing 215 at a spring loaded latch 2205 (see FIGS. 22A and 22B). The cleaning extractors 265, 270 are placed into the interior cavity 1505 by inserting an end of each of the cleaning extractors into a respective output gear and then closing the latch 1550 over each of the drive ends of the cleaning extractors 265, 270. The latch 1550 has a narrow profile to allow the cleaning extractors 265, 270 to extend substantially across the full lateral width of the cleaning head 200. The latch 1550 is shaped to match a portion of the cleaning extractors 265, 270 to hold the cleaning extractors 265, 270 in place and to reduce air gaps from the edge of the cleaning head 200.

In some implementations, the latch can include lap joints that are oriented based on the rotation of the extractors, creating a seal while being moveable by a user. For example, the lap joint (see 2210 of FIG. 22B) is oriented such that debris is pushed over the joint by an extractor rather than being pushed into the joint.

Figure 22A:
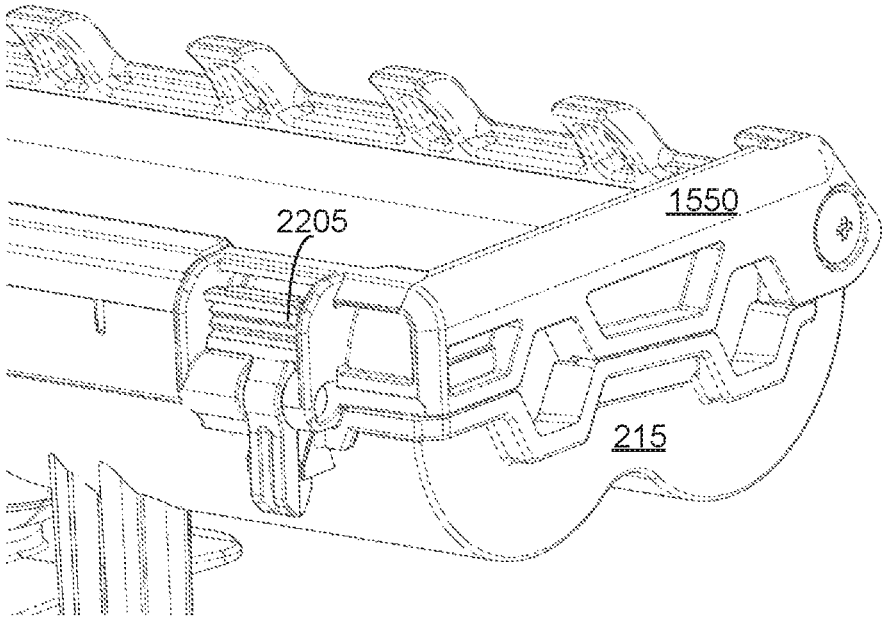
FIGS. 22A-22B are perspective views of an example latch of linkage the example cleaning head of FIG. 8.
Figure 22B:
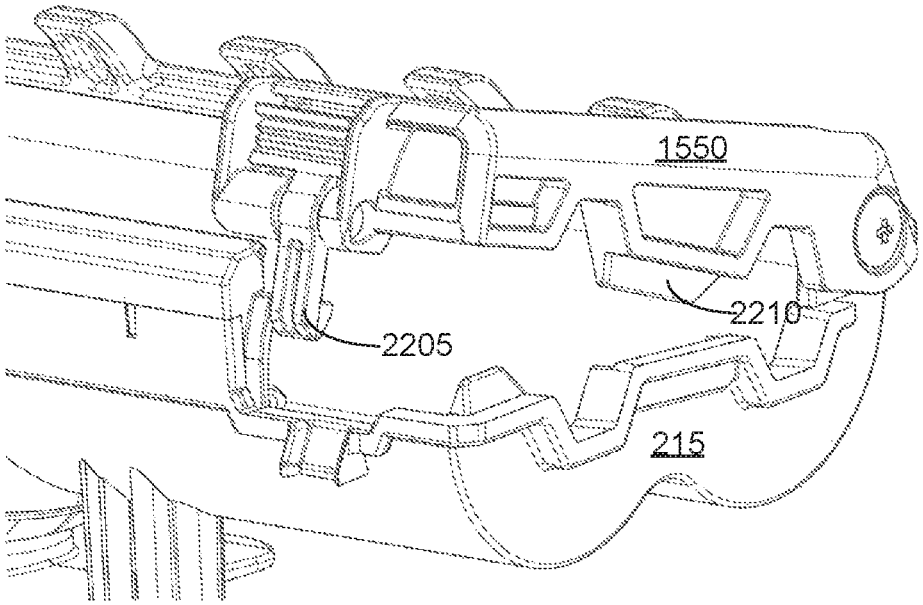

An implementation of the latch 1550 is shown in FIGS. 22A-22B. FIG. 22A shows latch 1550 in a closed position forming a seal for the monolithic housing 215. FIG. 22B shows latch 1550 in an open position for accessing the cleaning extractors 265, 270, such as removing the cleaning extractors 265, 270 for maintenance, etc. Latch 1550 includes a hinged snap 2205 for securing the latch 1550 in place. The latch 1550 allows the cleaning extractors 265, 270 to rotate freely inside the monolithic housing 215 while maintaining a seal. The latch 1550 includes lap joint 2210. The lap joint 2210 is oriented such that debris pushed against the latch 1550 by the extractor is pushed away from the joint rather than into the joint.

Returning to FIG. 15, the interior cavity 1505 is substantially sealed from air leaks. The negative pressure created on the cleaning surface is approximately equally strong across the entire length of the cleaning extractors 265, 270. For example, negative pressure near the edge of the cleaning extractors 265, 270 is approximately the same as the negative pressure that the near the center of the cleaning extractors 265, 270.

The interior cavity 1505 has the aperture 1015 to which the diaphragm 410 is sealed using the second seal 1005. The interior cavity 1505 and the diaphragm 410 together cause the air in the airflow path to proceed through the diaphragm 410 and into the rigid duct 405. The second seal 1005 smoothly integrates the diaphragm 410 with the interior cavity 1505 of the monolithic housing 215 as described in relation to FIG. 10, above. The smooth integration of the diaphragm 410 and the interior cavity 1505 allows airflow to lift debris from the cleaning surface at any location under the monolithic housing 215 carry the debris through the diaphragm 410 without getting it stuck or caught.

The rigid duct 405 completes the airflow path of the cleaning head 200 opposite the diaphragm 410 from the monolithic housing 215. The rigid duct 405 can include a debris detection sensor 1535 for detecting debris in debris-laden air flowing through the airflow path. In some implementations, the debris detection sensor 1535 includes a piezoelectric sensor. The debris activates the debris detection sensor 1535 by impacting the sensor in the airflow. The debris detection sensor 1535 monitors the airflow path to determine whether the area of the cleaning surface on which the robot 100 is navigating is clean or whether additional cleaning operation should be performed. The debris detection sensor 1535 can be approximately 1-2 centimeters in diameter. The debris detection sensor 1535 is embedded in the rigid duct 405 at a location in which debris in debris-laden air flowing through the rigid duct 405 will impact the debris detection sensor. In some implementations, the debris detection sensor 1535 is located near a curve of the rigid duct 405 such that debris being carried in the airflow path impact the sensor during operation of the robot 100. The cleaning head 200 is fastened to the chassis 310 using the screw bosses 1530*a-d* of the frame 205.

Figure 16:
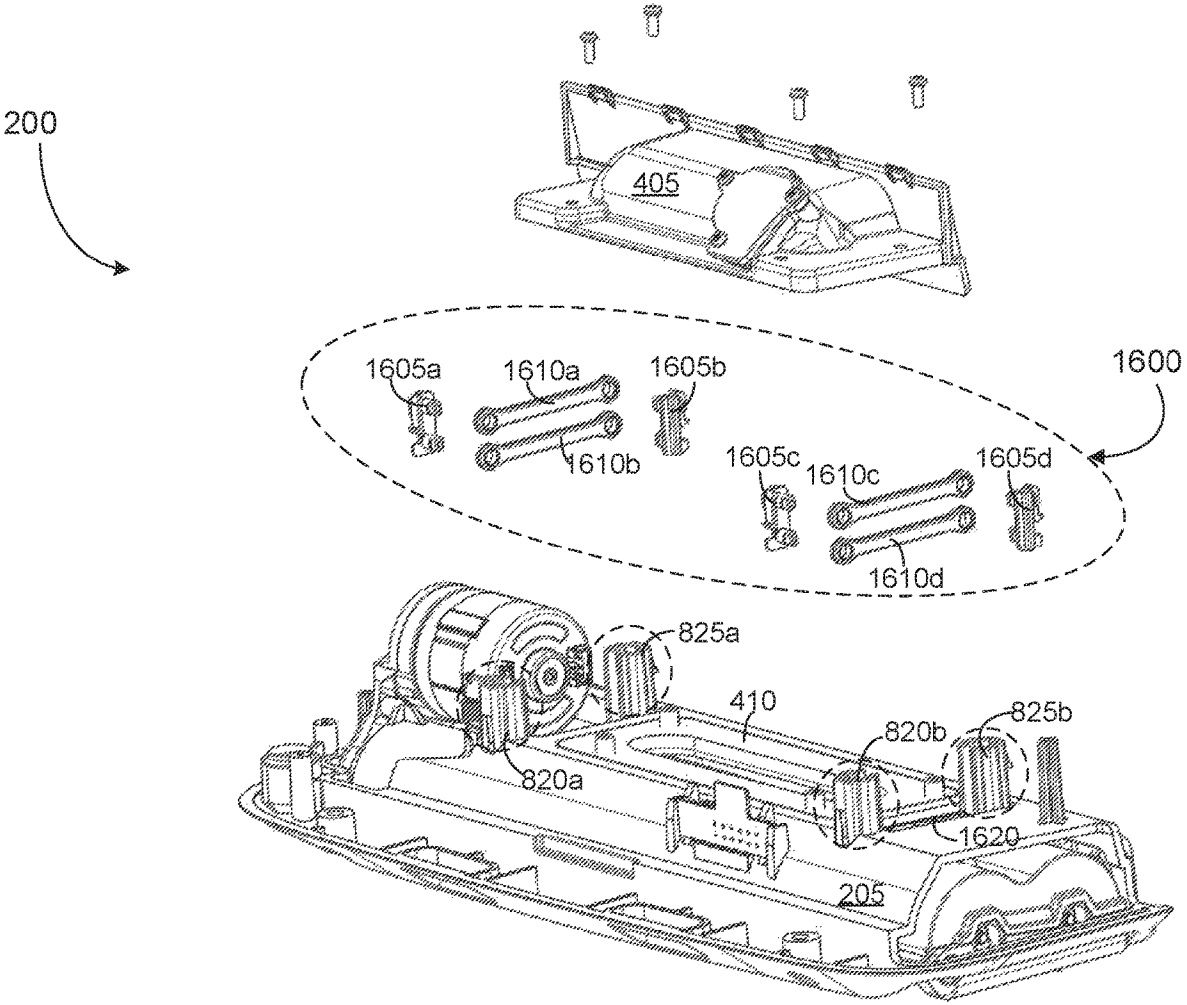
FIG. 16 is an exploded perspective view of the example cleaning head of FIG. 8.

FIG. 16 shows an exploded view of an implementation of suspension linkage 1600 (designated by the dashed lines) of the cleaning head 200. Suspension links 1610*a-d* can be slotted into connected pin joints, such as joints 1605*a-d*. The pin joints 1605*a-d* are slotted into the linkage carriers, such as carries 820*b*, 825*b* (e.g., as shown by arrows 1905 and 1910 of FIG. 19A). In some implementations, the suspension links 1610*a-d* are linear, such as not having any bends or angles along the suspension links 1610*a-d*, and are approximately parallel to one another to form the suspension linkage 1600. The joints 1605*a-d* are inserted into the frame linkage carriers 820*a*, 820*b* and the monolithic housing linkage carriers 825*a*, 825*b*. In this implementation, rather than pinning the members 1610*a-d* to the carriers 825*a-b* and 820*a-b* with screws, the joints 1605*a-d* are inserted into slots in the carriers 825*a-b* and 820*a-b*. The joints 1605*a-d* are slotted into the carriers 825*a-b* and 820*a-b* and snap into place, facilitating assembly. The carriers 825*a-b* and 820*a-b* are each configured such that the joints 1605*a-d* can only be inserted into their carriers in a particular orientation so that the suspension links 1610*a-d* rotate in the desired direction.

The carriers 820*a-b* and 825*a-b* hold the suspension links 1610*a-d* in place without using screws or pins and allow the suspension links 1610*a-d* to pivot. This motion accommodates the vertical translation of the monolithic housing 215. The suspension linkage 1600 permits the monolithic housing 215 to translate toward and away from the cleaning surface and remain approximately parallel to the cleaning surface. In some implementations, a tuned spring (e.g., tuned spring 1705 of FIG. 17) compensates for an asymmetric load about the suspension linkage 1600 caused by a weight of the suspended monolithic housing. The asymmetry is introduced by the motor 810 and gearbox 220 disposed on the monolithic housing 215. The tuned spring 1705 balances the monolithic housing 215 so that the monolithic housing 215 remains roughly parallel to the cleaning surface during operation along the lateral axis. Such a configuration allows the monolithic housing 215 to hang from the suspension linkage 1600 without putting a load on the diaphragm 410. The monolithic housing 215 can adjust to forces exerted on the cleaning extractors 265, 270 by the cleaning surface, allowing the cleaning extractors to sweep up debris into the airflow path. The pivots of the suspension linkage 1600 can be adjusted to allow the monolithic housing 215 to move with minimal friction in the suspension linkage 1600 such that the monolithic housing moves freely and easily.

Figure 17:
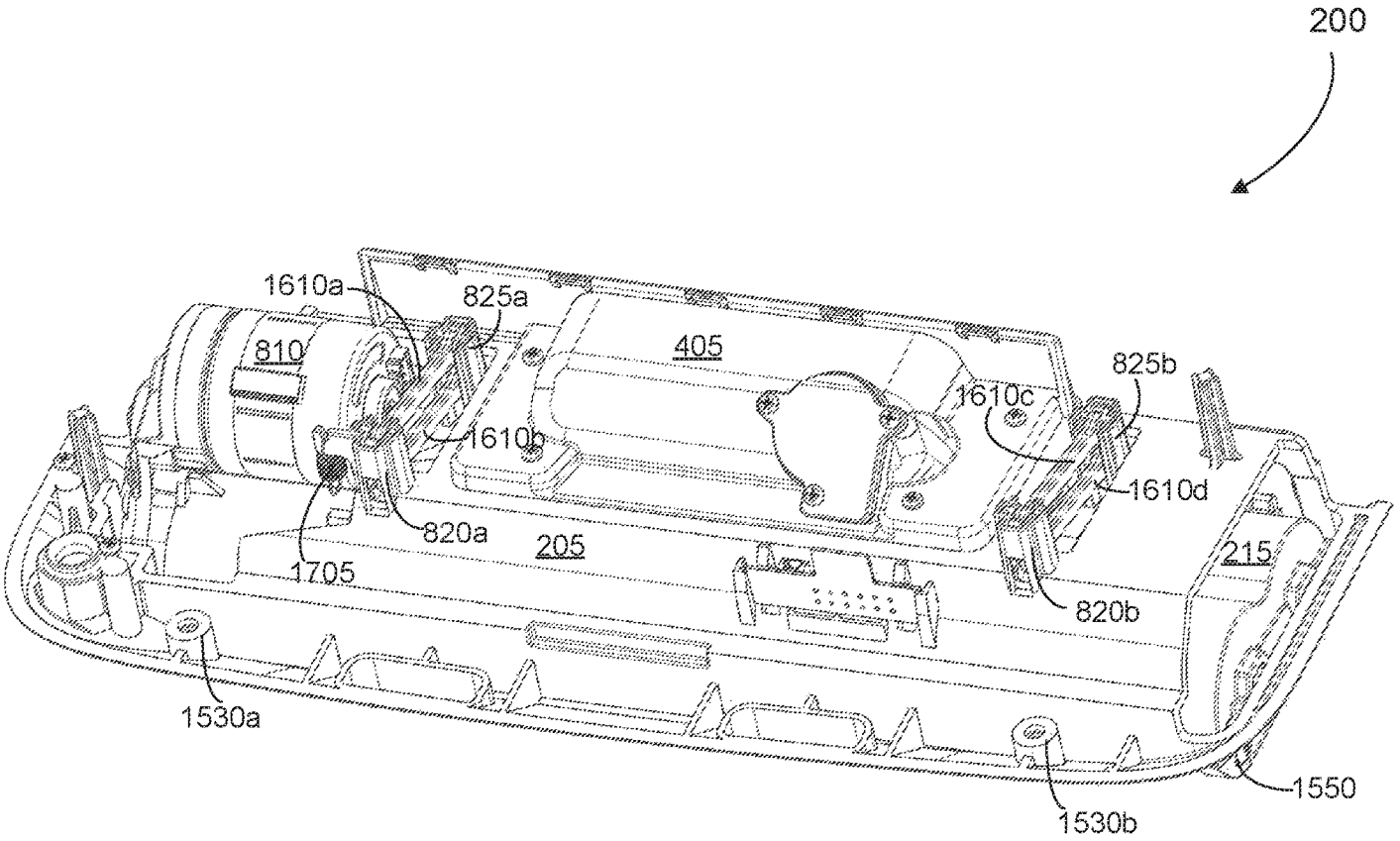
FIGS. 17-18 are perspective views of the example cleaning head of FIG. 8.
Figure 18:
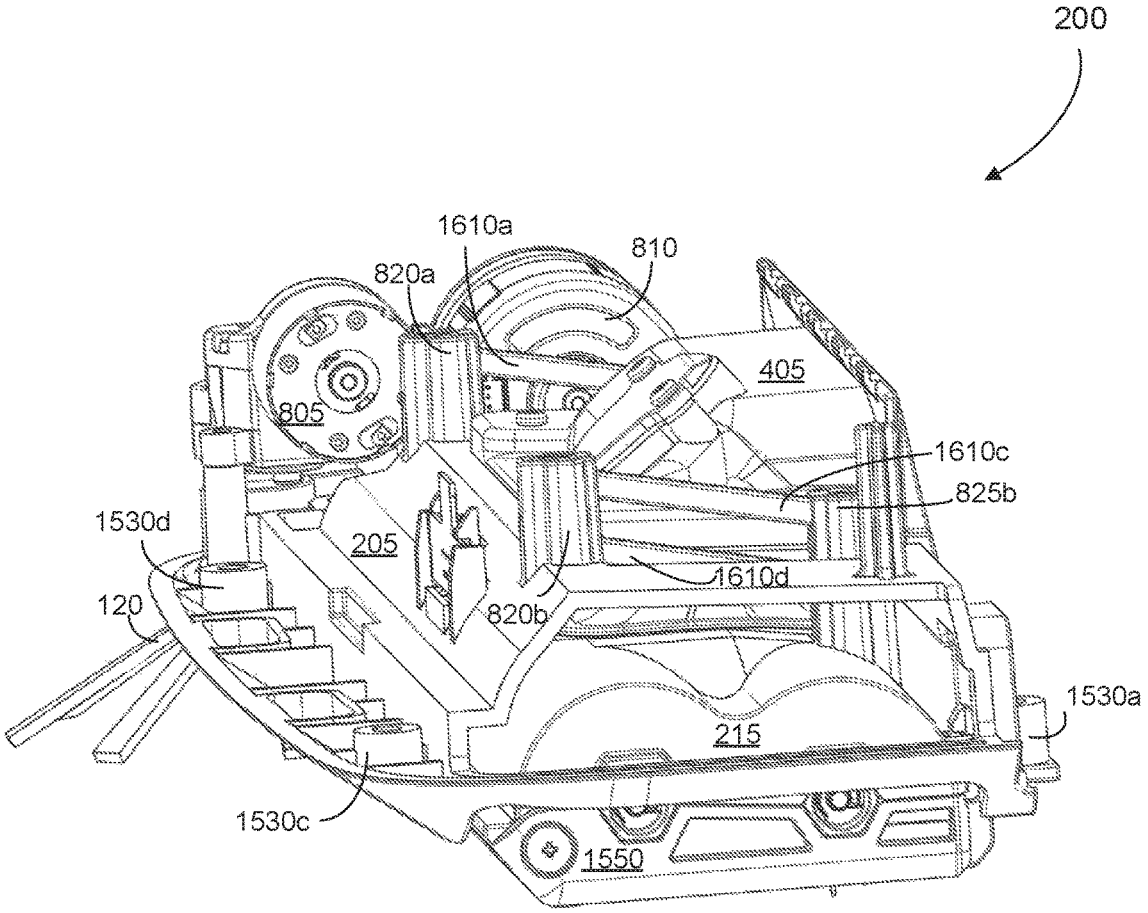

FIGS. 17-18 are perspective views of the cleaning head 200 showing a suspension linkage 1600 for movably suspending the monolithic housing 215 from the frame 205 over a cleaning surface, such as during cleaning operation. The suspension linkage 1600 allows the monolithic housing 215 to move toward and away from the cleaning surface and conform to undulations in the cleaning surface with greater flexibility than the frame 205 (and robot body 105). The suspension linkage 1600 connects the monolithic housing 215 to the frame 205 above the monolithic housing 215. This configuration allows the monolithic housing 215 to extend further along the lateral axis 150 of the cleaning head 200 than would be possible if the suspension linkage 1600 were on a side of the monolithic housing 215. The longer monolithic housing 215 increases the area of the cleaning surface that is exposed to suction of the cleaning head 200. The cleaning extractors 265, 270 can be made longer to fit in the longer monolithic housing 215 and clean more of the cleaning surface with each pass of the robot 100.

The suspension linkage 1600 connects to the exterior of the monolithic housing 215 such that the airflow path is not exposed to the suspension linkage 1600. The four carriers 820*a,b* 825*a,b* are astride the aperture 1015 of the diaphragm 410. The monolithic housing 215 is suspended from the suspension linkage 1600 such that the bottom of the monolithic housing 215 floats or accommodates undulations of the cleaning surface. The suspension linkage 1600 supports the monolithic housing 215 without extending below the monolithic housing 215, which potentially would cause air gaps between the monolithic housing 215 and the cleaning surface. The suspension linkage 1600 allows the monolithic housing 200 to float above the cleaning surface and suspend from the diaphragm 410 so that very small changes in the cleaning surface, such as small undulations, are engaged by the monolithic housing 215 and engaged by the cleaning extractors 265, 270. When the robot 100 is navigating around a cleaning surface, the surface may quickly change texture or shape. The configuration of the suspension linkage 1600 and diaphragm 410 enable the monolithic housing 215 to ride the cleaning surface without introducing mechanical delays. The mechanical delays may cause air gaps to form between the monolithic housing 215 and the cleaning surface and reduce suction of the robot 100 on the cleaning surface. In some implementations, the suspension linkage 1600 includes two or more suspension links, including suspension links 1610*a-d* that connect the monolithic housing 215 to the frame 205.

The suspension links 1610*a-d* straddle either side of the rigid duct 405 along the longitudinal length of the cleaning head 200 and are inwardly spaced from the lateral ends of the monolithic housing 215. In some implementations, the suspension links 1610*a-d* can be on one side of the rigid duct 405. The tuned spring 1705 balances the load of the monolithic housing 215 on the diaphragm 410 and linkage 1600 to ensure that the monolithic housing 215 is roughly parallel to the cleaning surface. The disposition of the suspension linkage 1600 above the monolithic housing 215 allows for long suspension links 1610*a-d* to be used relative to a suspension linkage that is positioned adjacent to a lateral end of the monolithic housing 215 because there is more room for a range of motion of the suspension linkage 1600.

Longer suspension links allow for a greater range of movement than shorter suspension links, such as a more vertical motion of the monolithic housing 215 with less arcing between the lower state and the retracted state of the monolithic housing 215. The range of motion of the monolithic housing 215 by the suspension linkage 1600 is between 0-8 mm (e.g., 0-2 mm, 1-5 mm, 1-2 mm, 1-4 mm, etc.).

The suspension linkage 1600 enables the monolithic housing 215 to ride along the cleaning surface independently of the movement of the frame 205. In some implementations, the suspension links 1610*a-d* are proximate either end of the lateral axis 150 of the robot 100 such that the monolithic housing 215 can move symmetrically across the lateral axis 150 of the robot 100. For example, the monolithic housing 215 can move evenly on each end in response to undulations of the cleaning surface.

Continuing reference to FIGS. 17-18, the frame 205 supports the monolithic housing 215 and is used to affix the cleaning head 200 to the chassis 310 of the robot 100. The frame 205 can be affixed to the chassis 310 of the robot 100 using screws or other similar fastening mechanisms, such as through screw bosses 1530*a-c* in the frame 205. The frame 205 wraps around the monolithic housing 215 and is shaped to complete the bottom of the robot 100. The frame 205 is shaped to form a substantially smooth and continuous surface with the cover 245 of the robot 100. The frame 205 completes formation of the bottom of the robot 100 and reduces or eliminates airflow leakage along the bottom surface of the robot 100. By reducing airflow leakages, airflow velocity is maintained.

The frame 205 includes one or more carriers for receiving the linkage, such as frame linkage carriers 820*a*, 820*b*, that extend from the frame for connecting to suspension links 1610*a-d*. The frame linkage carriers 820*a*, 820*b* serve as a portion of the frame 205 to which suspension links 1610*a-d* can be affixed. The suspension links 1610*a-d* can be affixed to the frame 205 using pins, screws, or other similar fastening mechanisms that allow the joint to pivot. In some implementations, the frame linkage carriers 820*a*, 820*b* are on either side of the rigid duct 405 along the lateral axis 150 of the cleaning head 200. In some implementations, the frame linkage carriers 820*a*, 820*b* can be formed in a single molding step of the frame 205 such that the frame 205 forms a continuous piece of material with the frame linkage carriers 820*a*, 820*b*.

The monolithic housing 215 includes one or more carriers for receiving the linkage, such as housing linkage carriers 825*a*, 825*b*, that complete the suspension linkage 1600 along with the suspension links 1610*a-d* and the frame linkage carriers 820*a*, 820*b*. The housing linkage carriers extend from the exterior of the monolithic housing 215 parallel to the frame linkage carriers 820*a*, 820*b*. In some implementations, the housing linkage carriers extend up through gaps or slits in the frame 205 (e.g., gap 1620 of FIG. 16) such that the chassis protects the suspension linkage 1600 from side loads which might damage the suspension linkage 1600. In some implementations, the housing linkage carriers can be formed in a single molding step of the monolithic housing 215 such that the monolithic housing 215 forms a continuous piece of material with the housing linkage carriers. The suspension links 1610*a-d* are affixed to the housing linkage carriers. In some implementations, the suspension links 1610*a-d* can be affixed pins, screws, or other similar fastening mechanisms that allow the joint to pivot.

The suspension links 1610*a-d* are substantially rectangular members with holes on either end for affixing to other pieces of the robot 100. The suspension links 1610*a-d* are rigid or semi-rigid such that the suspension links 1610*a-d* can support the monolithic housing 215 without warping or breaking. The suspension links 1610*a-d* can be formed from a similar material to the monolithic housing 215 or the chassis 310. The holes of the suspension links 1610*a-d* are configured to receive pins, screws, or other similar fastening mechanisms that allow the joint to pivot. The suspension links 1610*a-d* are affixed to the frame linkage carriers 820*a*, 820*b* and the housing linkage carriers at either end of the suspension links. The suspension links 1610*a-d* are affixed to the frame linkage carriers 820*a*, 820*b* and the housing linkage carriers using the pin, screw, etc. The frame linkage carriers 820*a*, 820*b*, housing linkage carriers, and suspension links 1610*a-d* form the suspension linkage 1600. The suspension linkage 1600 includes at least two suspension links 1610*a-d* affixed to each chassis protrusion and housing linkage carrier 825*a*. In some implementations, two sets of housing and frame linkage carriers 820*a*, 820*b* are linked, creating a four-bar suspension linkage.

The suspension linkage 1600 movably suspends the monolithic housing 215 from the frame 205 such that the cleaning extractors 265, 270 are suspended below the bottom portion of the robot 100 and can engage with the cleaning surface. The suspension linkage 1600 allows the cleaning extractors 265, 270 to accommodate undulations by translating vertically while maintaining a constant and consistent engagement with the cleaning surface. Such movement assists the cleaning extractors 265, 270 for sweeping up the debris and extracting it into the airflow path without resistance from the cleaning surface. In some implementations in which there multiple cleaning extractors, the suspension linkage 1600 allows the cleaning head 200 to suspend from the chassis 310 at an angle such that a cleaning extractor closer to the leading edge 125 of the robot 100 is raised above a cleaning extractor closer to the trailing edge 130 of the robot 100. Such a configuration can assist the cleaning head 200 in removing larger debris from the cleaning surface. In some implementations, the monolithic housing 215 can move in a vertical direction at least approximately eight millimeters. In some implementations, the vertical range can be between 0-2 mm, 1-5 mm, 1-2 mm, 1-4 mm, etc.

In some implementations, a flexible hinge, called a "living hinge," can be used in place of suspension links 1610*a-d*. The living hinge is a flex-bearing hinge of the suspension linkage that enables the suspension linkage to be constructed from a singled molded piece of plastic.

Figure 19A:
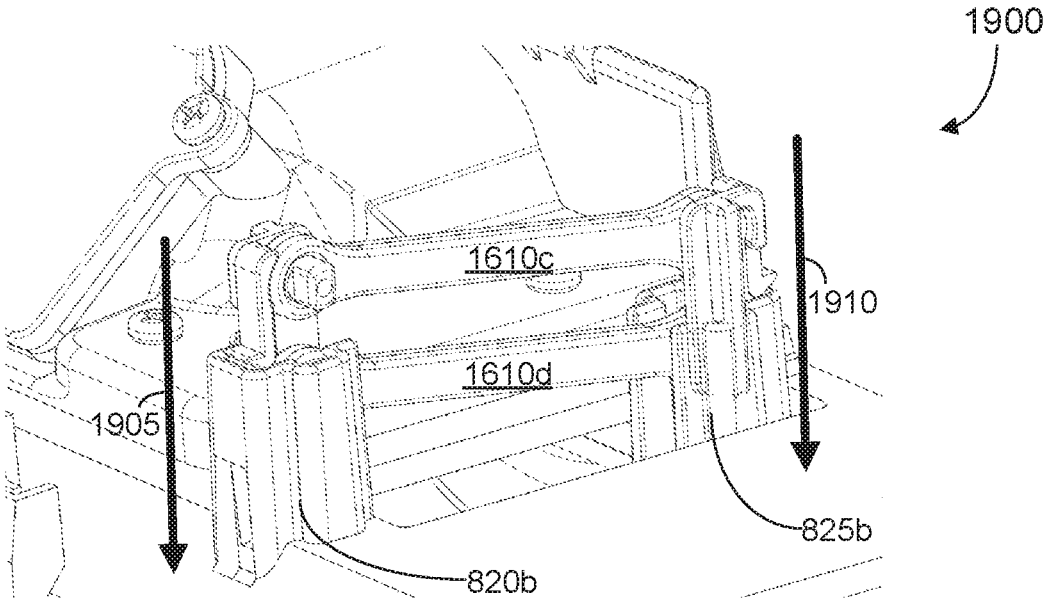
FIG. 19A is a perspective view of an example suspension linkage the example cleaning head of FIG. 8.
Figure 19B:
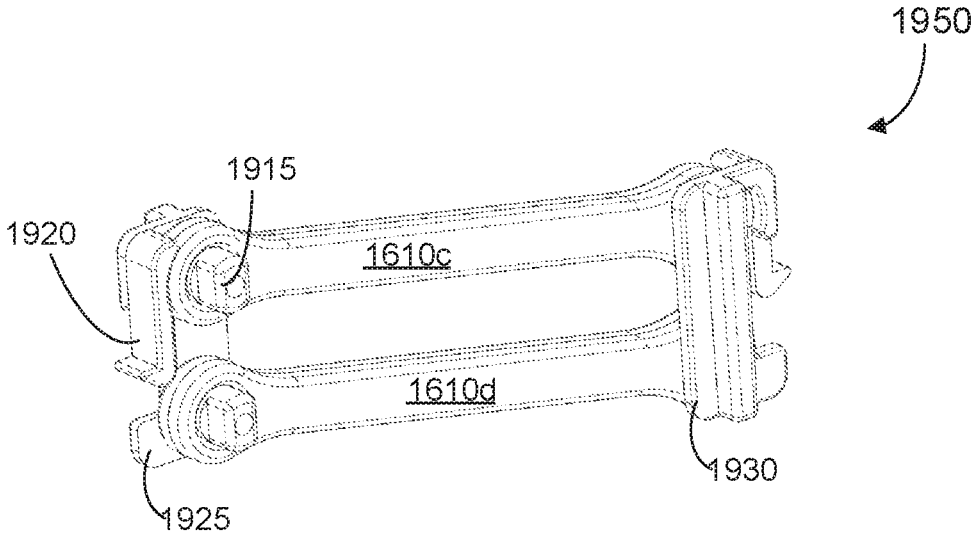
FIG. 19B is a perspective view of a suspension linkage the example cleaning head of FIG. 8.

FIG. 19A shows a close up view of the suspension linkage assembly 1900. FIG. 19B shows a suspension links configuration 1950. The suspension links 1610*a*, 1610*b* extend between pin joint 1930 and pin joint 1925. Pin joints 1925, 1930 can be inserted into the protrusions of the housing of the cleaning head and the frame of the cleaning head. The pin joints 1925, 1930 include a snap 1920 for mating with a suspension carrier of the monolithic housing 200 or the frame 205. The pin joints 1925, 1930 include pins 1915 for receiving the suspension links 1610*a-d*. The suspension links 1610*a-d* include terminal apertures (e.g., holes) to receive the pins 1915. In some implementations, the pin joints 1925, 1930 can include joints 1605*a-d*. As described above, arrows 1905, 1910 show how the pin joints 1925, 1930 can be inserted into the carriers (e.g., carriers 820*b*, 825*b*).

Figure 20:
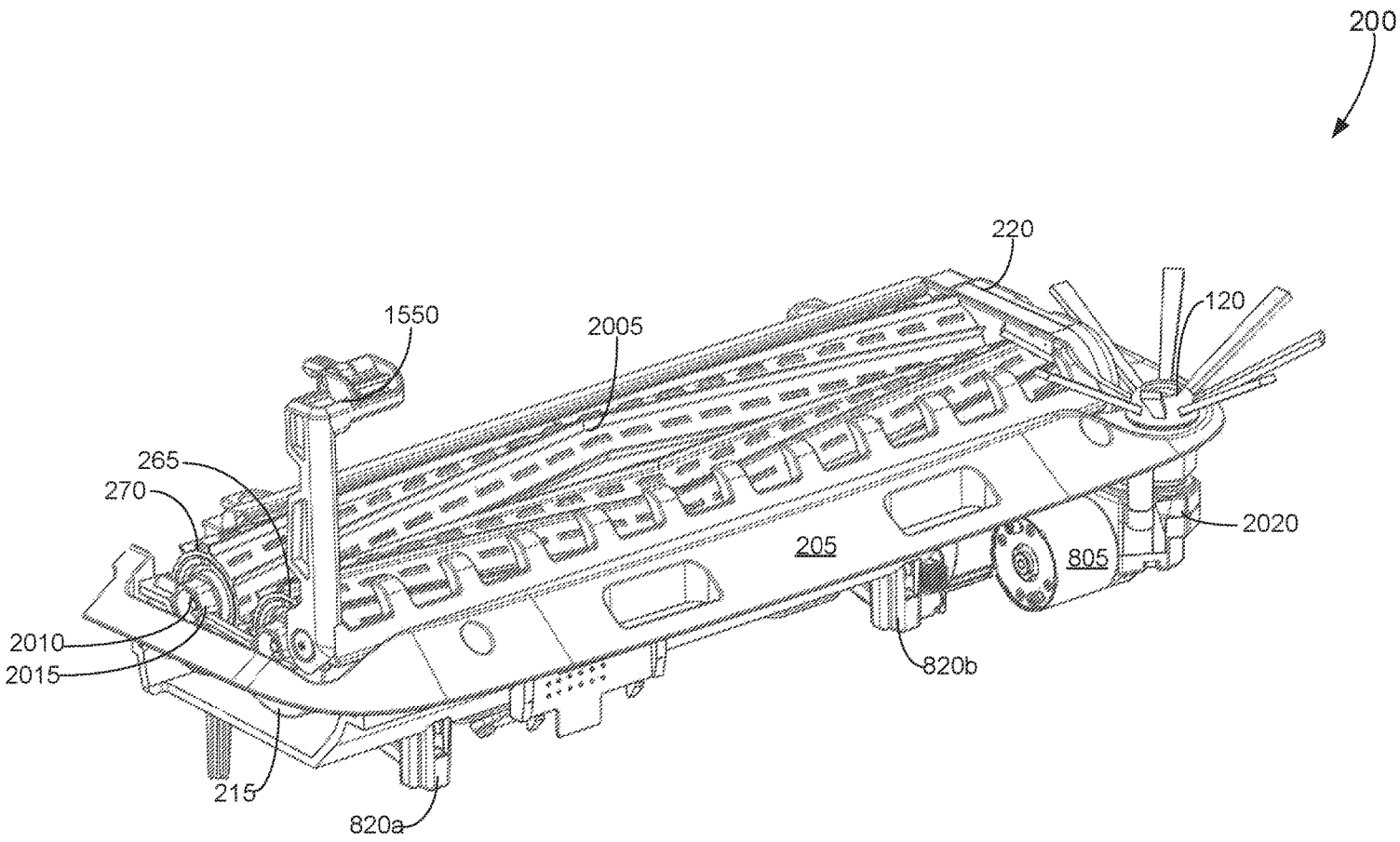
FIGS. 20-21 are perspective bottom views of a portion of linkage the example cleaning head of FIG. 8.

FIG. 20 shows a perspective view of the cleaning head 200 including cleaning extractors 265, 270 that are disposed in the monolithic housing 215. In some implementations, the cleaning extractors 265, 270 are tubular rollers. The cleaning extractors 265, 270 include pliable exteriors that conform to the cleaning surface to extract debris. A pliable exterior can be formed of a polymer (e.g., rubber).

In some implementations, the pliable exterior encases a hard axis that extends the length of the cleaning extractor 265. The axis can be formed of a rigid or semi-rigid material such as a metal or plastic. A keyed end (not shown) of the axis includes a keyed shape to match an output gear (e.g., output gear 1525) of the cleaning head 200. The keyed end of the axis fits snugly into the output gear such that there is little or no mechanical slop. When the output gear is turned, the cleaning extractor 265 spins. An opposing end 2010 of the axis has a free-spinning cover 2015 that fits into a groove of the latch 1550. The cover does not spin when the axis of the cleaning extractor 265 is rotated by the output gear but rather is held in place by the spring-latch 1550. The latch 1550 holds the opposing end of the axis snugly in place such that the cleaning extractor 265 does not vibrate when rotated. In some implementations, the cleaning extractor 265 is small in diameter relative to the length of the cleaning extractor 265. For example, the diameter of the first roller 265 can be 16% of the length of the roller. For example, the diameter of the cleaning extractor 265 can be from 10% to 30% of the length of the roller. In some implementations, the spring latch is close to an edge of the robot 100.

The pliable exterior of the cleaning extractor 265 engages the cleaning surface and sweeps debris into the airflow path. In some implementations, cleaning extractor 265 is similar to or the same as cleaning extractor 270. The cleaning extractors 265, 270 can be disposed in parallel to one another in the interior cavity 1505 of the monolithic housing 215. For example, the cleaning extractor 265 can be disposed in the first output gear 1520 and the second roller 265 can be disposed in the second output gear 1525, and both the cleaning extractors 265, 270 can be fastened into the interior cavity 1505 by the latch 1550. The output gears can be driven in opposing directions. For example, the first output gear 1520 can be driven by the cleaning extractor gearbox 220 in a clockwise motion and the second output gear 1525 can be driven by the cleaning extractor gearbox 220 in an anticlockwise motion. The output gears drive the cleaning extractors 265, 270 toward one another. The cleaning extractor 270 sweeps debris that may have passed by the cleaning head 200 initially back into the center of the cleaning head 200 and into the airflow path. For example, the cleaning extractor 270 can sweep debris from the flexible barrier 910 back into the airflow path. The cleaning extractor 265 pulls debris into the airflow path from the cleaning surface. The cleaning extractor 265, which is disposed closer to the leading edge 125 of the robot 100, initially agitates the cleaning surface after the raking prows 210 have passed over it. For example, the raking prows 210 can rake through a carpet to push away large objects. Remaining debris can be pulled into the airflow path of the cleaning head 200 by the cleaning extractor 265. Any dust or debris that passed beneath the cleaning extractor 265 is engaged by the cleaning extractor 270, which sweeps the debris back into the airflow path.

Figure 21:
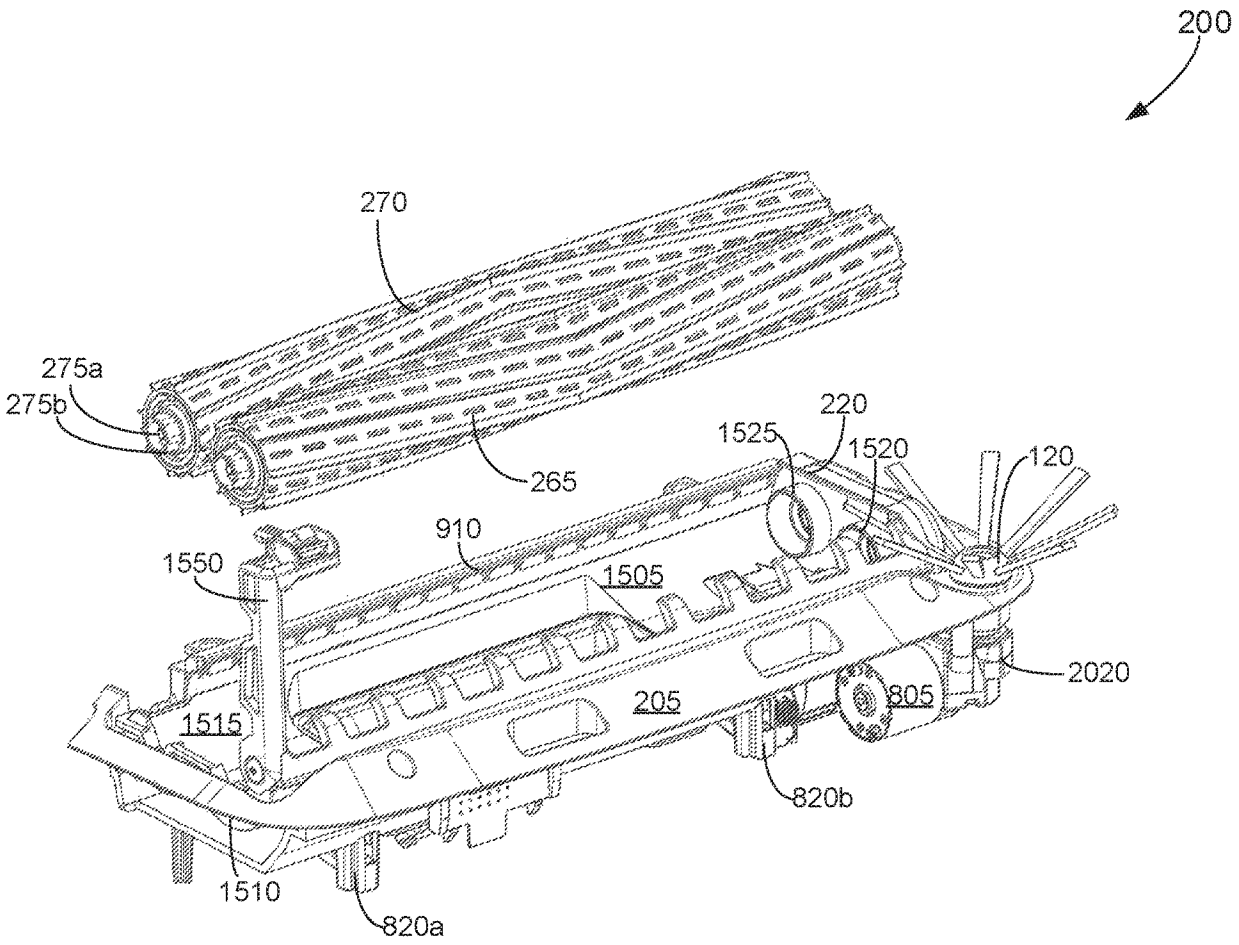

FIG. 21 shows a perspective view of the cleaning head 200 including cleaning extractors 265, 270 that are removed from the monolithic housing 215. The first output gear 1520 and the second output gear 1525 are disposed in the interior cavity 1505 of the monolithic housing 215. The spring-latch 1550 is in an open position such that the first and second rollers 265, 270 can be removed from the interior cavity 1505. The first sub-cavity 915 (e.g., shown in FIG. 15) for the first roller 270 and the second sub-cavity 920 (e.g., shown in FIG. 15) for the second roller 265 are parallel to each other such that the first and second rollers 265, 270 are disposed in parallel. The sub-cavities are molded to fit the cleaning extractors 265, 270 being used by the robot 100 to direct airflow to the aperture 1015.

Although a few implementations have been described in detail above, other modifications are possible. Moreover, other mechanisms for the robot 100 may be used. Accordingly, other implementations are within the scope of the following claims.

What is claimed is:

1. A mobile cleaning robot comprising:
- a chassis that supports a drive system;
- a debris collection volume; and
- a cleaning head formed to complete a bottom of the robot, the cleaning head comprising:
  - a frame for affixing the cleaning head to the chassis;
  - a monolithic housing having an interior cavity;
  - a suspension linkage movably suspending the monolithic housing from the frame, the suspension linkage being configured to lift the monolithic housing;
  - a diaphragm formed of a flexible material and mated to the monolithic housing;
  - a rigid duct mated to the frame to form a pneumatic path between the monolithic housing and the rigid duct through the diaphragm; and
  - cleaning extractors disposed in the interior cavity of the monolithic housing.

2. The mobile cleaning robot of claim 1, further comprising:
- a square forward portion comprising a lateral axis from a first side to a second side, the cleaning head being integrated into the square forward portion across the lateral axis of the square forward portion, the cleaning extractors extending across the lateral axis within 1 centimeter of one of the first or second sides.

3. The mobile cleaning robot of claim 2, further comprising:
- a corner brush disposed in a position of the square forward portion between a leading edge of the forward portion and the cleaning extractors; and
- a motor for driving the corner brush, the motor being positioned inside the frame in a vertical configuration with the corner brush, and wherein the drive system is further from the leading edge than the cleaning extractors.

4. The mobile cleaning robot of claim 1, the diaphragm further comprising:
- a first seal formed with the rigid duct by compressing an extension of the diaphragm; and
- a second seal formed with the monolithic housing and comprising a double flange configuration having a top flange and a bottom flange separated by a receiving channel, the receiving channel receiving a lip of the monolithic housing, the bottom flange received through an aperture of the monolithic housing into the interior cavity of the monolithic housing and the top flange being mated to a top surface of the monolithic housing,
- wherein mating the diaphragm to the monolithic housing forms the pneumatic path from the interior cavity of the monolithic housing to an intake port of the debris collection volume.

5. The mobile cleaning robot of claim 4, wherein mating the diaphragm to the monolithic housing comprises forming a chemical bond between the diaphragm and the monolithic housing.

6. The mobile cleaning robot of claim 4, wherein the first seal is formed by a knife-edge seal of the rigid duct pressing into the diaphragm extension.

7. The mobile cleaning robot of claim 1, the suspension linkage comprising a four-bar assembly coupling the moveable monolithic housing to the chassis, the suspension linkage attached adjacent the pneumatic path and inwardly spaced from lateral ends of the monolithic housing.

8. The mobile cleaning robot of claim 1, the monolithic housing being constructed from a single molded piece of rigid material shaped to conform the interior cavity to a shape of the cleaning extractors disposed in the interior cavity, and wherein the frame is shaped to form a beveled bottom edge.

9. The mobile cleaning robot of claim 1, the monolithic housing further comprising:

output gears configured to receive the cleaning extractors, the output gears each comprising a seal, the cleaning extractors being pliable tubular rollers; and a latch configured to secure the pliable tubular rollers inside the interior cavity.

10. The mobile cleaning robot of claim 9, further comprising:

a gearbox in communication with the output gears configured to drive the output gears and rotate the cleaning extractors, the gearbox being adjacent to an end of the monolithic housing and extending less than three centimeters from the end of the monolithic housing; and a motor for driving the gearbox, the motor affixed to a top of the monolithic housing.

11. The mobile cleaning robot of claim 1, wherein the cleaning head further comprises a tuned spring that balances the monolithic housing to maintain the monolithic housing approximately parallel to the cleaning surface during operation.

12. The mobile cleaning robot of claim 1, wherein the suspension linkage further comprises:

housing carriers that are formed from the monolithic housing;

frame carriers that are formed from the frame;

suspension links that connect the frame carriers to the housing carriers; and joints that receive the suspension links on pins of the joints and allow the suspension links to pivot around the pins, wherein the housing carriers and frame carriers are configured to receive the joints.

13. The mobile cleaning robot of claim 1, wherein the suspension linkage and the diaphragm are configured to allow the monolithic housing to float along the cleaning surface independent of the movement of the frame.

14. The mobile cleaning robot of claim 1, wherein the rigid duct comprises a debris detection sensor.

15. The mobile cleaning robot of claim 1, further comprising an aft cover, wherein the aft cover mates with the frame to complete the bottom of the robot.

16. The mobile cleaning robot of claim 1, further comprising a bin well for receiving the debris collection volume, wherein the bin well is covered by a lid during cleaning operation, and wherein the cleaning operation are restricted when the lid is ajar.

17. The mobile cleaning robot of claim 1, wherein the diaphragm folds when the monolithic housing is in a raised state, and wherein the diaphragm does not reduce a cross-section of the pneumatic airflow path through the diaphragm by folding.

18. The mobile cleaning robot of claim 1, wherein the suspension linkage comprises a flex-bearing hinge.

19. The mobile cleaning robot of claim 1, wherein the rigid duct forms a seal with an intake port of the debris collection volume.

20. The mobile cleaning robot of claim 1, further comprising a latch configured to secure the cleaning extractors in the monolithic housing, the latch comprising a lap joint to seal with the monolithic housing, wherein the lap joint is oriented to reduce debris buildup in the lap joint relative to another orientation of the lap joint.

* * * * *